US011356762B2

(12) United States Patent
Woelfl

(10) Patent No.: US 11,356,762 B2
(45) Date of Patent: Jun. 7, 2022

(54) HEADPHONE ARRANGEMENTS FOR GENERATING NATURAL DIRECTIONAL PINNA CUES

(71) Applicant: Harman Becker Automotive Systems GmbH, Karlsbad (DE)

(72) Inventor: Genaro Woelfl, Straubing (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 0 days.

(21) Appl. No.: 16/964,783

(22) PCT Filed: Jan. 24, 2018

(86) PCT No.: PCT/EP2018/051618
§ 371 (c)(1),
(2) Date: Jul. 24, 2020

(87) PCT Pub. No.: WO2019/145023
PCT Pub. Date: Aug. 1, 2019

(65) Prior Publication Data

US 2021/0058693 A1 Feb. 25, 2021

(51) Int. Cl.
*H04R 1/10* (2006.01)
*H04R 1/28* (2006.01)

(52) U.S. Cl.
CPC ..... *H04R 1/1008* (2013.01); *H04R 1/2807* (2013.01)

(58) Field of Classification Search
CPC ..... H04R 1/10; H04R 1/1008; H04R 1/1016; H04R 1/105; H04R 1/1058; H04R 1/1066; H04R 1/1075; H04R 1/2807
See application file for complete search history.

(56) References Cited

U.S. PATENT DOCUMENTS 3,927,262 A * 12/1975 Goeckel ..... H04R 5/033 381/19
4,389,542 A * 6/1983 Gorike ..... H04R 1/225 381/372

(Continued)

FOREIGN PATENT DOCUMENTS

CN 205320245 U * 6/2016
CN 205320245 U 6/2016

(Continued)

OTHER PUBLICATIONS

International Search Report dated Jun. 8, 2018, Application No. PCT/EP2018/051618 filed Jan. 24, 2018, 11 pgs.

(Continued)

*Primary Examiner* — Oyesola C Ojo
(74) *Attorney, Agent, or Firm* — Brooks Kushman P.C.

(57) ABSTRACT

A headphone arrangement includes an ear cup configured to be arranged to at least partly surround an ear of a user to define an at least partly enclosed volume about the ear of the user. The ear cup includes an at least partially hollow frame configured to at least partially enframe the ear of the user when the ear cup is arranged to surround the ear of the user. The frame includes a first cavity, the first cavity being formed by wall portions of the frame. The headphone arrangement includes at least one loudspeaker arranged within wall portions of the first cavity. The wall portions of the first cavity form a first waveguide configured to guide sound radiated from the loudspeaker through a waveguide output of the first waveguide. The waveguide output of the first waveguide includes one or more openings in the first cavity.

24 Claims, 9 Drawing Sheets

(56) References Cited

U.S. PATENT DOCUMENTS

| | | | | |
|---|---|---|---|---|
| 6,038,330 | A | 3/2000 | Meucci, Jr. | |
| 7,463,748 | B2 | 12/2008 | Yang | |
| 7,532,734 | B2 | 5/2009 | Pham et al. | |
| 2003/0103637 | A1* | 6/2003 | Huang | H04R 1/1075 381/74 |
| 2004/0218775 | A1* | 11/2004 | Huang | H04R 5/033 381/186 |
| 2004/0264727 | A1* | 12/2004 | Kim | H04R 1/2819 381/370 |
| 2009/0209304 | A1* | 8/2009 | Ngia | H04R 1/1091 455/575.2 |
| 2014/0153765 | A1 | 6/2014 | Gan et al. | |
| 2014/0226843 | A1* | 8/2014 | Pan | H04R 1/1075 381/309 |
| 2015/0055814 | A1* | 2/2015 | Liu | H04R 5/033 381/373 |
| 2017/0006373 | A1 | 1/2017 | Bruss | |
| 2017/0201822 | A1 | 7/2017 | Shetye et al. | |
| 2019/0116411 | A1* | 4/2019 | Duckwall | H04R 1/1008 |

FOREIGN PATENT DOCUMENTS

| | | | | | |
|---|---|---|---|---|---|
| EP | 0705053 | A2 | | 4/1996 | |
| EP | 2552125 | A1 | | 1/2013 | |
| EP | 2667379 | A1 | | 11/2013 | |
| EP | 2611214 | B1 | | 4/2016 | |
| FR | 2854537 | A1 | | 11/2004 | |
| JP | H05336599 | A | | 12/1993 | |
| JP | 2000078698 | | | 3/2000 | |
| JP | 2012094942 | A | * | 5/2012 | H04R 5/02 |
| JP | 2012094942 | A | | 5/2012 | |
| JP | 2014155229 | A | | 8/2014 | |
| KR | 20050054604 | A | * | 6/2005 | H04R 1/1008 |
| KR | 1020050054604 | A | | 6/2005 | |
| KR | 20050068028 | A | * | 7/2005 | H04R 1/1075 |
| KR | 1020050068028 | A | | 7/2005 | |
| WO | 03019978 | A2 | | 3/2003 | |
| WO | 03086124 | A1 | | 10/2003 | |
| WO | 2004082329 | A1 | | 9/2004 | |
| WO | WO-2004082329 | A1 | * | 9/2004 | H04R 5/033 |
| WO | 2005034574 | A1 | | 4/2005 | |
| WO | 2012134399 | A1 | | 10/2012 | |

OTHER PUBLICATIONS

Sunder, K. et al., "Individualization of Binaural Synthesis Using Frontal Projection Headphones", J. Audio Eng. Soc., Dec. 2013, 12 pgs., vol. 61, No. 12.

Sunder, K. et al., "On the Study of Frontal-Emitter Headphone to Improve 3D Audio Playback", AES Convention Paper 3760, Oct. 26-29, 2012, 10 pgs.

Chinese Office Action for Application No. 201880087680.1 filed Jan. 24, 2018, dated Mar. 9, 2022, 10 pgs.

Japanese Office Action for Application No. 2020-540619 filed Jan. 24, 2018, dated Jan. 24, 2022, 6 pgs.

* cited by examiner

HEADPHONE ARRANGEMENTS FOR GENERATING NATURAL DIRECTIONAL PINNA CUES

CROSS-REFERENCE TO RELATED APPLICATION

This application is the U.S. National Phase of PCT Appln. No. PCT/EP2018/051618, filed on Jan. 24, 2018 the disclosure of which is incorporated in its entirety by reference herein.

TECHNICAL FIELD

The disclosure relates to headphone arrangements for controlled generation of natural directional pinna cues, in particular for improving the spatial representation of stereo as well as 2D and 3D surround sound content over headphones.

BACKGROUND

Most headphones available on the market today produce an in-head sound image when driven by a conventionally mixed stereo signal. "In-head sound image" in this context means that the predominant part of the sound image is perceived as being originated inside the listeners head, usually on an axis between the ears. If sound is externalized by suitable signal processing methods (externalizing in this context means the manipulation of the spatial representation in a way such that the predominant part of the sound image is perceived as being originated outside the listeners head), the center image tends to move mainly upwards instead of moving towards the front of the listener. While especially binaural techniques based on Head Related Transfer Function (HRTF) filtering are very effective in externalizing the sound image and even positioning virtual sound sources on most positions around the listeners head, such techniques usually fail to position virtual sources correctly on a frontal part of the median plane (in front of the user). This means that neither the (phantom) center image of conventional stereo systems nor the center channel of common surround sound formats can be reproduced at the correct position when played over commercially available headphones, although those positions can be considered the most important positions for stereo and surround sound presentation.

SUMMARY

A headphone arrangement includes an ear cup configured to be arranged to at least partly surround an ear of a user, thereby defining an at least partly enclosed volume about the ear of the user, wherein the ear cup includes an at least partially hollow frame configured to at least partially enframe the ear of the user when the ear cup is arranged to surround the ear of the user, and wherein the frame includes a first cavity, the first cavity being formed by wall portions of the frame. The headphone arrangement further includes at least one loudspeaker arranged within wall portions of the first cavity, wherein wall portions of the first cavity form a first waveguide configured to guide sound radiated from the loudspeaker through a waveguide output of the first waveguide, and wherein the waveguide output of the first waveguide includes one or more openings in the first cavity.

Other systems, methods, features and advantages will be or will become apparent to one with skill in the art upon examination of the following detailed description and figures. It is intended that all such additional systems, methods, features and advantages be included within this description, be within the scope of the invention and be protected by the following claims.

BRIEF DESCRIPTION OF THE DRAWINGS

The method may be better understood with reference to the following description and drawings. The components in the figures are not necessarily to scale, emphasis instead being placed upon illustrating the principles of the invention. Moreover, in the figures, like referenced numerals designate corresponding parts throughout the different views.

DETAILED DESCRIPTION

Most headphones available on the market today produce an in-head sound image when driven by a conventionally mixed stereo signal. "In-head sound image" in this context means that the predominant part of the sound image is perceived as being originated inside the user's head, usually on an axis between the ears (running through the left and the right ear, see axis x in FIG. 3). 5.1 surround sound systems usually use five speaker channels, namely front left and right channel, center channel and two surround rear channels. If a stereo or 5.1 speaker system is used instead of headphones, the phantom center image or center channel image is produced in front of the user. When using headphones, however, these center images are usually perceived in the middle of the axis between the user's ears.

Figure 3:
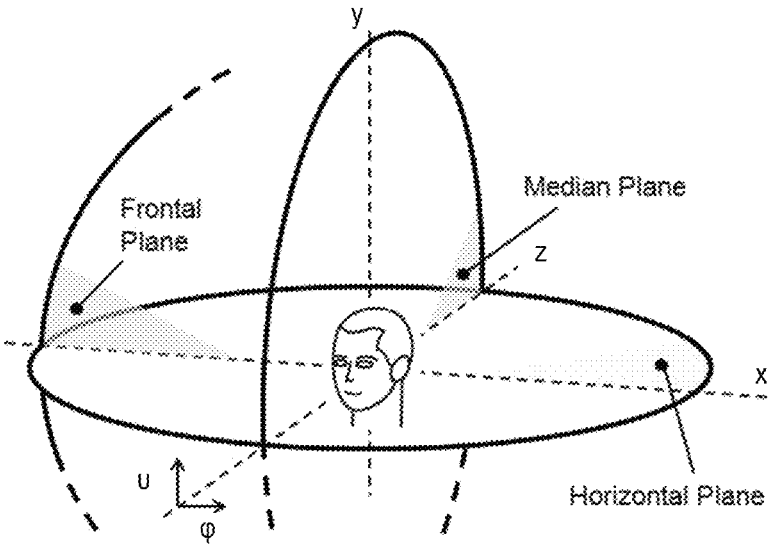
FIG. 3 schematically illustrates various planes and angles for source localization.

Sound source positions in the space surrounding the user can be described by means of an azimuth angle ci (position left to right), an elevation angle v (position up and down) and a distance measure (distance of the sound source from the user). The azimuth and the elevation angle are usually sufficient to describe the direction of a sound source. The human auditory system uses several cues for sound source localization, including interaural time difference (ITD), interaural level difference (ILD), and pinna resonance and cancellation effects, that are all combined within the head related transfer function (HRTF). FIG. 3 illustrates the planes of source localization, namely a horizontal plane (also called transverse plane) which is generally parallel to the ground surface and which divides the user's head in an upper part and a lower part, a median plane (also called midsagittal plane) which is perpendicular to the horizontal plane and which crosses the user's head approximately midway between the user's ears, thereby dividing the head into essentially mirror-symmetrical left and right half sides, and a frontal plane (also called coronal plane) which equally divides anterior aspects and posterior aspects of the head and which lies at right angles to both the horizontal plane and the median plane. Azimuth angle (p and elevation angle v are also illustrated in FIG. 3 as well as the three axes x, y, z. Within this document, different sound sources and sound source arrangements will be discussed, mostly with reference to a single ear (e.g., right ear). Headphones are usually designed identically for both ears with respect to acoustical characteristics and are placed on both ears in a virtually similar position relative to the respective ear. A first axis x runs through the ears of the user 2. In the following, it will be assumed that the first axis x crosses the concha of the user's ear. The first axis x is parallel to the frontal plane and the horizontal plane, and perpendicular to the median plane. A second axis y runs vertically through the user's head, perpendicular to the first axis x. The second axis y is parallel to the median plane and the frontal plane, and perpendicular to the horizontal plane. A third axis z runs horizontally through the user's head (from front to back), perpendicular to the first axis x and the second axis y. The third axis z is parallel to the median plane and the horizontal plane, and perpendicular to the frontal plane. The position of the different planes x, y, z will be described in greater detail below.

Figure 1A:
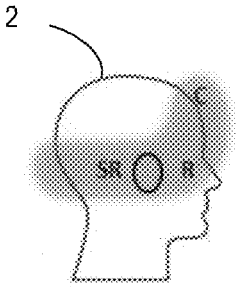
FIG. 1, including FIGS. 1A and 1B, schematically illustrates a typical path of virtual sources positioned around a user's head.
Figure 1B:
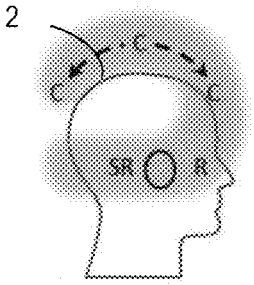

If sound in conventional headphone arrangements is externalized by suitable signal processing methods (externalizing in this context means that at least the predominant part of the sound image is perceived as being originated outside the user's head), the center channel image tends to move mainly upwards instead of to the front. This is exemplarily illustrated in FIG. 1A, wherein SR identifies the surround rear image location, R identifies the front right image location and C identifies the center channel image location. Virtual sound sources may, for example, be located somewhere on and travel along the path of possible source locations as is indicated in FIG. 1A if the azimuth angle (p (see FIG. 3) is incrementally shifted from 0° to 360° for binaural synthesis, based on generalized head related transfer functions (HRTF) from the horizontal plane. While especially binaural techniques based on HRTF filtering are very effective in externalizing the sound image and even positioning virtual sound sources on most positions around the user's head, such techniques usually fail to position sources correctly on a frontal part of the median plane. A further problem that may occur is the so-called front-back confusion, as is illustrated in FIG. 1B. Front-back confusion means that the user 2 is not able to locate the image reliably in the front of his head, but anywhere above or even behind his head. This means that neither the center sound image of conventional stereo systems nor the center channel sound image of common surround sound formats can be reproduced at the correct position when played over commercially available headphones, although those positions are the most important positions for stereo and surround sound presentation.

Sound sources that are arranged in the median plane (azimuth angle $\varphi=0°$) lack interaural differences in time (ITD) and level (ILD) which could be used to position virtual sources. If a sound source is located on the median plane, the distance between the sound source and the ear as well as the shading of the ear through the head are the same to both the right ear and the left ear. Therefore, the time the sound needs to travel from the sound source to the right ear is the same as the time the sound needs to travel from the sound source to the left ear and the amplitude response alteration caused by the shading of the ear through parts of the head is also equal for both ears. The human auditory system analyzes cancellation and resonance magnification effects that are produced by the pinnae, referred to as pinna resonances in the following, to determine the elevation angle on the median plane. Each source elevation angle and each pinna generally provokes very specific and distinct pinna resonances.

Pinna resonances may be applied to a signal by means of filters derived from HRTF measurements. However, attempts to apply foreign (e.g., from another human individual), generalized (e.g., averaged over a representative group of individuals), or simplified HRTF filters usually fail to deliver a stable location of the source in the front, due to strong deviations between the individual pinnae. Only individual HRTF filters are usually able to generate stable frontal images on the median plane if applied in combination with individual headphone equalizing. However, such a degree of individualization of signal processing is almost impossible for consumer mass market.

Figure 2:
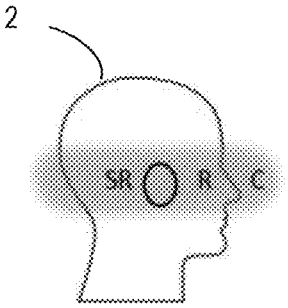
FIG. 2 schematically illustrates a possible path of virtual sources positioned around a user's head.

Headphone arrangements are known that are capable of generating strong directional pinna cues for the frontal hemisphere in front of a user's head 2 and/or appropriate cues for the rear hemisphere behind the user's head 2. Some of these headphone arrangements support the generation of an improved centered frontal sound image and some headphone arrangements are further capable of positioning virtual sound sources all around the user's head 2, if combined with appropriate signal processing. This is exemplarily illustrated in FIG. 2, where the center channel image C is located at a desired position in front of the user's head 2. If directional pinna cues associated with the frontal and rear hemisphere are available and can be individually controlled, for example if they are produced by separate sound sources, it is possible to position virtual sources all around the user's head if, in addition, suitable signal processing is applied. Additionally, directional pinna cues from above and below the user 2 may be induced to improve the placement of the virtual sources in the respective hemisphere.

Signal processing methods are known which combine directional cues produced by natural pinna resonances with HRTF-based signal processing to improve directional sound image generation. Headphone arrangements for generation of directional pinna cues may be combined with such signal processing methods.

The spatial characteristics of headphones are usually less important than general sound quality attributes such as tonal balance, a wide working frequency range and low distortion. If the general sound quality is inferior to typical headphone standards, spatial effects are usually rejected by users, especially for stereo playback. Therefore, a fundamental characteristic of known open headphone arrangements is that the arrangements are not substantially worse in general sound quality aspects than other typical headphones that are available today, although, depending on the specific implementation, low frequency output may be lower than, for example, for closed headphones. Especially the playback of low frequencies usually requires physical structures of considerable size to be positioned around the user's ear. The reduction of negative effects of such structures on the controlled induction of natural directional pinna cues is one of the main aspects of the known headphone arrangement. Any further size reduction of these physical structures may further reduce such negative effects. Controlled induction of natural directional pinna cues can serve multiple purposes. As has been described before, the localization accuracy of virtual sources on the median plane can be improved by inducing suitable directional pinna cues. Another advantage over conventional binaural synthesis based on generalized HRTFs is the improved tonality, because the user is presented with his own spectral shape cues which are, in contrast to foreign spectral shape cues, not perceived as disturbing tonality alterations. On the other hand, directional pinna cues may also be suppressed in a controlled way by superposition of multiple essentially contradicting directional cues as provided by some of the known headphone arrangements. This provides an ideal basis for conventional binaural synthesis based on generalized or individual HRTFs, because no disturbing directional pinna cues are generated by the headphone arrangement. Conventional binaural synthesis that is based on generalized or individual HRTFs is currently the de facto standard for virtual and augmented reality applications which often only provide a binaural (2 channel) signal. Therefore, compatibility to this format is an important feature that is supported by some of the known headphone arrangements as well as by the embodiments of the headphone arrangements disclosed herein. Finally, even normal stereo playback without any spatial processing may benefit from headphone arrangements that do not produce uncontrolled comb filtering effects which may result from reflections inside a headphone structure and disturb the tonality of reproduced sound. In addition to improved spatial imaging and tonality, the known headphone arrangements are particularly well suited for augmented reality applications, for example, because the natural sound field reaches the ear of the user virtually unaltered. Furthermore, some of the known headphone arrangements solve problems of conventional headphones such as unwanted pressure on the ears or heat built up inside the ear cups, for example. These problems may be solved by the embodiments of the headphone arrangements disclosed herein.

Especially for the low frequency end of the audible range, maximum sound pressure levels produced by a headphone arrangement scale with the size of the ear cups of the headphone, especially if the headphone arrangement includes open ear cups. Open ear cups in this context refers to ear cups that are completely open in at least one direction (e.g., laterally). Another kind of ear cups are known as part of open-back headphones, which generally visually appear to have completely closed ear cups and merely provide relatively small ventilation paths in the otherwise closed ear cups. These open-back headphones position large loudspeakers laterally to the pinnae that cover the latter almost completely. Ear cups of Ooen-back headphones, therefore, are substantially different from open ear cups. Generally, a small size of the ear cups may be an important design factor for headphones. Therefore, it is desirable to get more sound output to the user's ears for a given set of loudspeakers and loudspeaker enclosure volumes, without losing the ability to induce natural directional pinna cues. Furthermore, open headphone arrangements are known that merely distribute sound sources around the ear, thereby severely limiting shape and size options for the ear cups. Therefore, the present invention proposes open or closed headphone constructions that provide higher sound pressure for a given open ear cup size than previously possible and at the same time allow for a wide range of closed, open and ventilated ear cup constructions, shapes and sizes with a range of different mechanic and acoustic characteristics. The proposed ear cup constructions are especially interesting for (completely) open or closed headphones with improved spatial representation as well as open headphones with typical stereo headphone sound image.

Besides the improved spatial imaging that the proposed headphone arrangements enable, the open ear cup embodiments are particularly well suited for augmented reality applications as the natural sound field reaches the ear virtually unaltered. Furthermore, comfort issues known from traditional headphones like pressure on the ears or heat that builds up inside the headphone are also solved by the open headphone constructions. Finally, the proposed ear cup constructions may be implemented such that there is low frequency response variation for different ears and ear cup placements as well as negligible directional bias from the headphone. This enables better performance for binaural synthesis based on generalized HRTF data as typically utilized by present virtual reality (VR) headsets.

Within this document, the terms pinna cues and pinna resonances are used to denominate the frequency and phase response alterations imposed by the pinna and possibly also the ear canal in response to the direction of arrival of the sound. The terms directional pinna cues and directional pinna resonances within this document have the same meaning as the terms pinna cues and pinna resonances, but are used to emphasize the directional aspect of the frequency and phase response alterations produced by the pinna. Furthermore, the terms natural pinna cues, natural directional pinna cues and natural pinna resonances are used to point out that these resonances are actually generated by the user's pinna in response to a sound field in contrast to signal processing that emulates the effects of the pinna. Generally, pinna resonances that carry distinct directional cues are excited if the pinna is subjected to a direct, approximately unidirectional sound field from the desired direction. This means that sound waves emanating from a source from a certain direction hit the pinna without the addition of very early reflected sounds of the same sound source from different directions. While humans are generally able to determine the direction of a sound source in the presence of typical early room reflections, reflections that arrive within a too short time window after the direct sound will alter the perceived sound direction. Therefore, headphone arrangements that send direct sound to the pinna while suppressing, or at least reducing, reflections from surfaces close to the pinna, therefore, are able to induce strong directional cues.

Known stereo headphones generally can be grouped into in-ear, over-ear and around-ear types. Around-ear types are commonly available as so-called closed-back headphones with a closed back or as so-called open-back headphones with a ventilated back. Headphones may include a single or multiple drivers (loudspeakers). Besides high quality in-ear headphones, specific multi-way surround sound headphones exist that utilize multiple loudspeakers aiming on generation of directional effects.

In-ear headphones are generally not able to generate natural pinna cues, due to the fact that the sound does not pass the pinna at all and is directly emitted into the ear canal. Within a fairly large frequency range, on-ear and around-ear headphones having a closed back produce a pressure chamber around the ear that usually either completely avoids pinna resonances or at least alters them in an unnatural way. In addition, this pressure chamber is directly coupled to the ear canal which alters ear canal resonances compared to an open sound-field, thereby further obscuring natural directional cues. At higher frequencies, elements of the ear cups reflect sound, whereby a partly diffuse sound field is produced that cannot induce pinna resonances associated with a single direction. In the following, solutions are presented as to how the sound field diffusion may be controlled (e.g., reduced or deliberately induced). However, closed-back headphones are generally not very well suited for the generation of individual natural directional pinna cues. Open-back headphones may avoid some of these drawbacks. Headphones with a closed ear cup forming an essentially closed chamber around the ear, however, also provide several advantages, e.g., with regard to loudspeaker sensitivity and frequency response extension. Therefore, a cover may be provided for an open headphone. The cover may be configured to be separably mountable/attachable to the open headphone construction to provide a closed headphone, in situations in which a closed headphone is preferred by the user. This allows the user to choose between an open or closed headphone based on his present preference. Therefore, the process of mounting and detaching the cover may be simple and may not require the use of any tool to allow the mounting and/or detaching process to be easily conducted by the user. The headphone may include a detection unit that is configured to detect whether the cover is mounted/attached to the headphone or not. When it is detected that the cover is mounted/attached to the headphone, which means that an essentially closed or ventilated chamber is provided around the ear, the equalizing may be adapted automatically (e.g., by means of an adaption unit) to compensate for the amplitude response differences between an open and a closed or ventilated ear cup.

Figure 23:
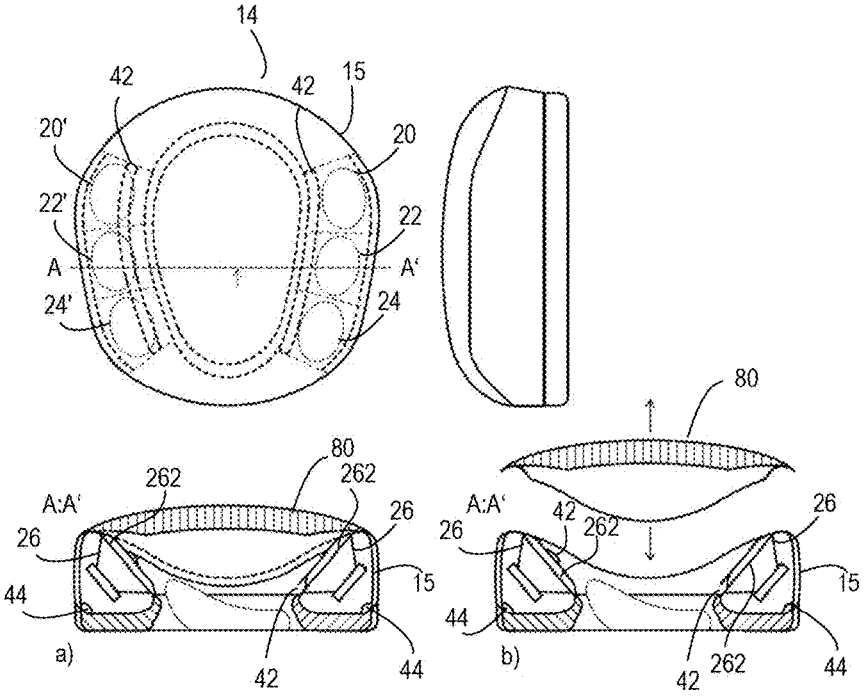
FIG. 23 schematically illustrates a further example of an ear cup.
Figure 24:
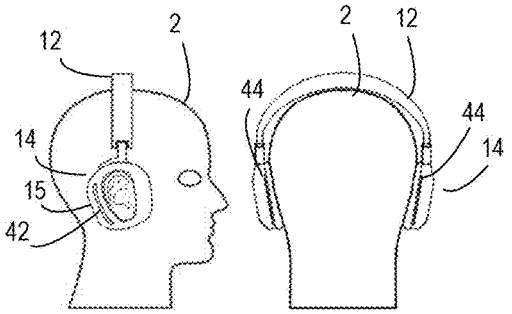
FIG. 24 schematically illustrates an open headphone arrangement with waveguides.

Such a headphone arrangement is illustrated in FIG. 23, for example. FIG. 23 *a*) schematically illustrates a closed ear cup 14, whereas FIG. 23 *b*) illustrates an open ear cup 14. The ear cup 14 comprises a frame 15 that is configured to be arranged around the ear of the user. One ear cup 14 may be provided for each ear. Two ear cups 14 generally may be held together by an over-the-head headband 12 (see, e.g., FIG. 24). This, however, is only an example. Two ear cups 14 may be held together in any other suitable way. The ear cup 14 may further comprise a cover 80 that may be separably mounted/attached on the frame 15 to obtain a closed ear cup headphone arrangement. The cover 80 can be removed from the frame 15 to obtain an open ear cup headphone arrangement 10. The cover 80 may be separably mounted/attached on the frame 15 in any suitable way, e.g. using brackets, magnets, or clamps. The arrangement in FIG. 24 schematically illustrates a user's head with open ear cups 14 arranged around the user's ears. In FIG. 24, a head band 12 is schematically illustrated that is configured to hold the ear cups 14 in place. One or more sound source arrangements may be arranged in the frame 15 of the ear cup 14 to provide sound to the user's ear. FIG. 23 further illustrates frontal 42 and rear 44 waveguide outputs of such sound source arrangements.

The ear cup 14 may at least partly surround the ear of a user when it is arranged around the ear of a user. This means that the ear cup 14 defines an open or a closed volume around the ear of the user. For example, the ear cup 14 may comprise a frame 15 but no cover 80. In this case, the volume around the ear of the user, which is defined by the ear cup 14, is open at least laterally (to the side of the user's head) when the ear cup 14 is arranged around the ear of the user. The frame 15 may completely or only partially surround the ear of the user when the ear cup 14 is arranged around the ear of the user. For example, the frame 15 may form a continuous frame around the ear of the user. However, it is also possible that the frame 15 comprises gaps or recesses. For example, the frame 15 may be arranged above, in front of and behind a user's ear but may comprise a gap or recess such that a section of the frame 15 below the user's ear is omitted. This, however, is only an example. The frame 15 may comprise one or more gaps or recesses anywhere along its circumference. The frame 15, therefore, may comprise one or more parts that may be coupled to each other in any suitable way. If the frame 15 comprises at least one recess within its circumference, the volume about the ear of the user is not fully enclosed, even if the ear cup 14 comprises a cover 80 which closes the volume around the ear of the user laterally (towards the side of the user's head). The frame 15 may be at least partially hollow. For example, the frame 15 may comprise one or more cavities on its inside. Such a cavity may be at least partially separated from the outside of the frame 15 by at least one wall portion of the frame 15. A cavity may be formed by one or more parts of the frame 14.

Typical open-back headphones as well as most closed-back around-ear and on-ear headphones that are available on the market today utilize large diameter loudspeakers. Such large diameter loudspeakers are often almost as big as the pinna itself, thereby producing a large plane sound wave from the side of the head that is not appropriate to generate consistent pinna resonances as would result from a directional sound field from the front. Additionally, the relatively large size of such loudspeakers as compared to the pinna, as well as the close distance between the loudspeaker and the pinna and the large reflective surface of such loudspeakers result in an acoustic situation, which resembles a pressure chamber for low to medium frequencies and a reflective environment for high frequencies. Even further, the loudspeaker membrane of such an arrangement is a relatively large reflective surface that reflects sound towards the pinna. This may cause peaks and dips in the in-ear frequency response, similar to those caused by natural pinna resonances. Such situations are detrimental to the induction of natural directional pinna cues associated with a single direction.

Surround sound headphones with multiple loudspeakers usually combine loudspeaker positions on the side of the pinna with a pressure chamber effect and reflective environments. Such headphones are usually not able to generate consistent directional pinna cues, especially not for the frontal hemisphere.

Generally all kinds of objects that cover the pinna, such as back covers of headphones or large loudspeakers themselves may cause multiple reflections within the chamber around the ear which generates a diffused sound field that is detrimental for natural pinna effects as caused by directional sound fields.

Therefore, embodiments of the present invention provide an optimized headphone arrangement that allows to send direct sound towards the pinna from all desired directions while minimizing reflections, in particular reflections hitting the user's pinna. While pinna resonances are widely accepted to be effective above frequencies of about 2 kHz, real world loudspeakers usually produce various kinds of noise and distortion that will allow the localization of the loudspeaker even for substantially lower frequencies. The user may also notice differences in distortion, temporal characteristics (e.g., decay time) and directivity between different speakers used within the frequency spectrum of the human voice. Therefore, a lower frequency limit in the order of about 200 Hz or lower may be chosen for the loudspeakers that are used to induce directional cues with natural pinna resonances, while reflections may be controlled at least for higher frequencies (e.g., above 2-4 kHz).

Generating a stable frontal image on the median plane presents the presumably highest challenge as compared to generating a stable image from other directions. Generally the generation of individual directional pinna cues is more important for the frontal hemisphere (in front of the user) than for the rear hemisphere (behind the user). Effective natural directional pinna cues, however, are easier to induce for the rear hemisphere for which the replacement with generalized cues is generally possible with good effects at least for standard headphones which place loudspeakers at the side of the pinna. Therefore, some headphone arrangements focus on optimization of frontal hemisphere cues while providing weaker, but still adequate, directional cues for the rear hemisphere. Other arrangements may provide equally good directional cues for each of the front and rear direction. To achieve strong natural directional pinna cues, the headphone arrangements may be configured such that the sound waves emanated by one or more loudspeakers mainly pass the pinna, or at least the concha, once from the desired direction with reduced energy in reflections that may occur from other directions. Some headphone arrangements focus on the reduction of reflections for loudspeakers in the frontal part of the ear cups, while other headphone arrangements minimize reflections independent from the position of the loudspeaker. It may be avoided putting the ear into a pressure chamber, at least above 2 kHz, or generating excessive reflections which tend to cause a diffuse sound field. To avoid reflections, at least one loudspeaker may be positioned on the ear cup such that it results in the desired direction of the sound field. The support structure or headband and the back volume of the ear cup may be arranged such that reflections are avoided or minimized.

Figure 4:
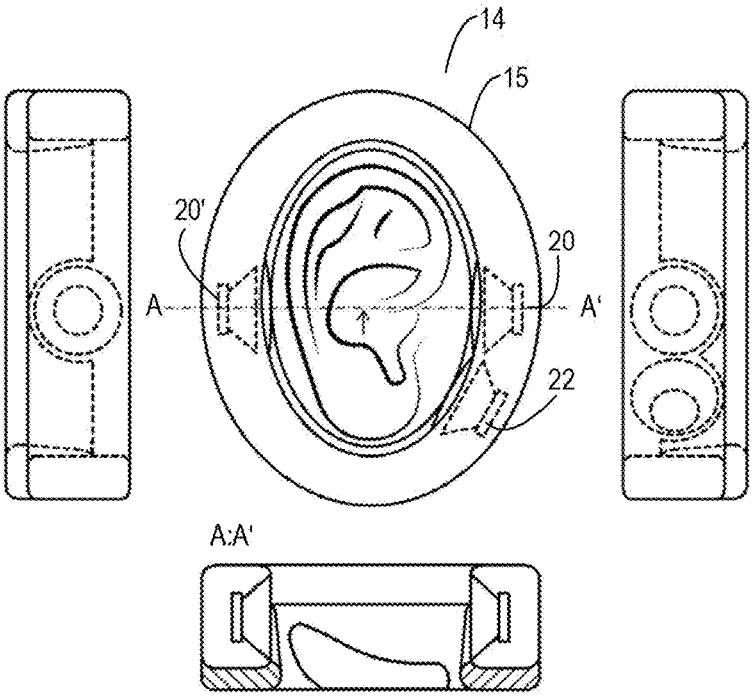
FIG. 4 schematically illustrates an example of an ear cup.

A headphone arrangement is exemplarily illustrated in FIG. 4. A ring shaped ear cup 14, which is completely open towards two sides and arranged around an ear of the user, comprises three loudspeakers 20, 20', 22 directing sound towards the ear. The ear cup 14 may define an open volume about the ear of the user 2, when the headphone arrangement is worn by the user 2. The ear cup 14 may further comprise a frame 15 arranged around the ear of the user, thereby enframing the ear at least partly when viewed from a position lateral to the user's head. The open volume formed by the ear cup 14 may, in particular, be essentially open to a side that faces away from the head of the user 2. This has already been described with respect to FIG. 23 above. The open volume about the ear of the user, therefore, may comprise each point in space that can be intersected at least by one straight line between two points on the external surface of the ear cup 14 without the straight line crossing any part of the ear cup 14. All loudspeakers 20, 20', 22 are mounted inside the ring shaped frame 15, which is at least partly hollow to provide at least one closed rear chamber volume or at least one cavity for the loudspeakers 20, 20', 22 that is separated from the outside by at least one wall of the frame 15. All loudspeaker membranes or diaphragms, in the following generally referred to as membranes, outside the rear chamber volume directly face or adjoin the open volume within the ear cup 14. Part of the surface of the inner wall of the frame 15 that faces the open volume within the ear cup 14 is covered by damping material (hatched areas in cross sectional view of FIG. 4) in order to reduce reflections towards the ear.

In FIG. 4, the hatched area in the cross-section along plane A: A' may comprise a sound absorbing foam, for example, which reduces reflections into the pinna and further functions as a cushion towards the user's head. In the example of FIG. 4, the main direction of sound propagation of the loudspeaker is almost parallel to the median plane and is not directed away from the pinna. Large parts of the inner wall of the ear cup frame 15 face the pinna. Sound absorbing material may, for example, be applied to surfaces or surface sections that surround the loudspeakers 20, 20', 22. At least parts of the surfaces or surface sections that are oriented essentially towards the pinna may comprise sound absorbing material, while the use of sound absorbing materials is optional for such surfaces or surface sections that are oriented essentially away from the pinna. The sound absorbing material may be configured to reduce the intensity of sound that is reflected by any surface or surface section of the ear cup 14 towards the pinna of the user. Such reflected sound may initially have been emitted by the at least one loudspeaker 20, 20', 22.

Figure 5:
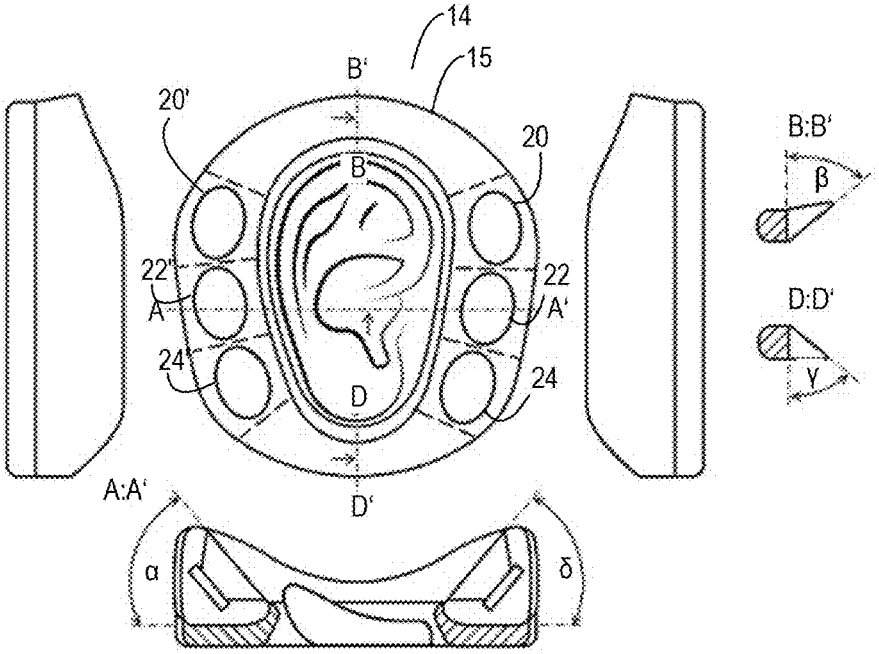
FIG. 5 schematically illustrates a further example of an ear cup.

Another headphone arrangement is illustrated in FIG. 5. In this example, the shape of the frame 15 is more complex with the inner contour adapted to typical ear shapes and the outer contour following the requirements that arise from the loudspeaker size and placement. The loudspeakers 20, 20', 22, 22', 24, 24' are tilted such that the side of the membrane and most of the frame wall surface respectively facing the open volume within the ear cup 14, face away from the median plane in order to reduce reflections towards the ear of the user. This second headphone arrangement as illustrated in FIG. 5, houses the back side of the loudspeakers in the at least one cavity of the at least partly hollow frame structure, thereby providing separate closed back volume chambers for each loudspeaker 20, 20', 22, 22', 24, 24'. As for the first headphone arrangement of FIG. 4, all loudspeaker membranes outside the rear chamber volume directly face the open volume within the ear cup 14. Again part of the frame wall-surface that faces the open volume within the ear cup 14 is covered by damping material (hatched areas in cross-sectional view of FIG. 5) in order to reduce reflections towards the ear.

The headphone arrangement of FIG. 5, comprises loudspeakers 20, 20', 22, 22', 24, 24' whose main direction of sound propagation is directed away from the pinna. In this example, additionally most of the inner wall sections are tilted away from the pinna. A frame 15 may comprise external surfaces or surface sections that are oriented essentially away from the pinna (the vertical of such external surface sections does not point towards the pinna when the headphone is worn by the user in a usual listening position). Other surfaces or surface sections may be oriented essentially towards the pinna, with the vertical pointing towards the pinna. At least some parts of those surfaces or surface sections that are oriented essentially towards the pinna may comprise a sound absorbing material. For example, more than 30%, more than 50% or more than 80% of the surface sections oriented towards the pinna may be covered with sound absorbing material. Surfaces or surface sections that are oriented essentially away from the pinna generally direct any reflections of sound mainly away from the pinna, therefore, such surfaces or surface sections might not necessarily comprise sound absorbing material. Surfaces or surface sections that are oriented essentially towards the pinna, however, generally direct the main part of the reflections towards the pinna. Therefore, sound absorbing material on such surfaces or surface sections may reduce the reflections that are directed towards the pinna. This is schematically illustrated in FIG. 5. Furthermore, it might not be necessary that all surfaces or surface sections that are oriented essentially towards the pinna comprise damping material. While surfaces or surface sections that are arranged opposite to a loudspeaker may comprise a sound absorbing material to reduce reflections, the use of sound absorbing materials may be optional for other surfaces or surface sections that are not arranged opposite to a loudspeaker, because such surfaces or surface sections might receive less direct sound and, therefore, cause less reflections. Surfaces or surface sections that are not opposing a loudspeaker may nevertheless be covered by sound absorbing material to reduce second order reflections into the pinna or concha area.

Figure 6:
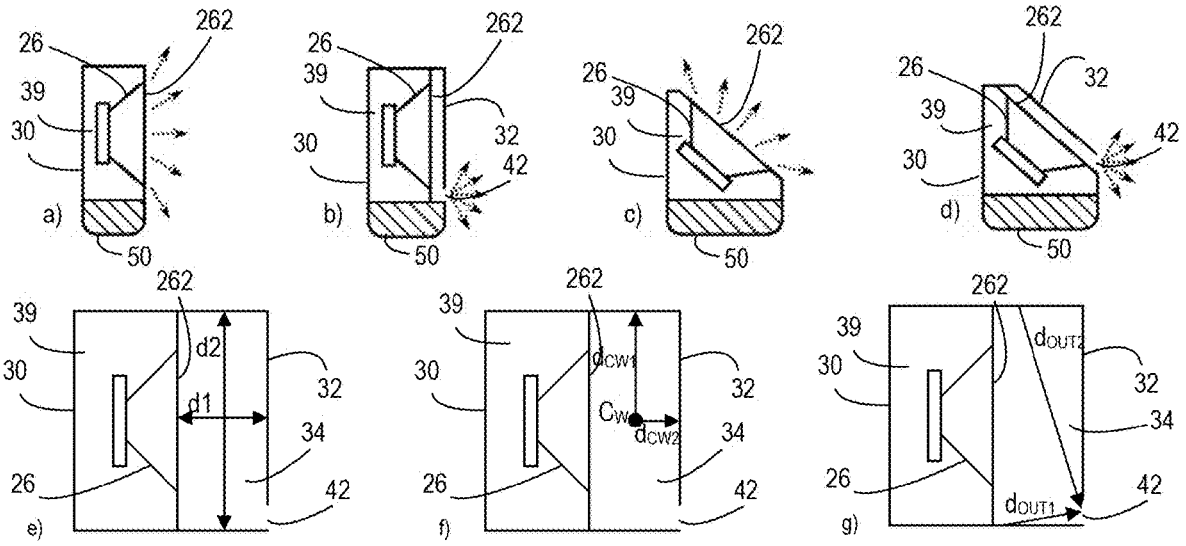
FIG. 6, including FIGS. 6 *a*) to *g*), schematically illustrates conventional sound source arrangements and examples of sound source arrangements with a frontal waveguide.

FIG. 6 schematically illustrates simplified cross-sectional drawings of a loudspeaker 26. The loudspeaker 26 is arranged in a loudspeaker enclosure 30. The loudspeaker enclosure may be formed by a cavity within a frame 15. The loudspeaker enclosure 30 may be a closed enclosure, that is, without any openings between the inside and the outside of the enclosure 30. The sound source arrangement including loudspeaker 26 and enclosure 30 radiates sound to the outside of the enclosure 30. The enclosure 30 may be formed by wall portions of the frame 15 of an ear cup 14, as has been described with reference to FIGS. 4 and 5 above. FIGS. 6 *a*) and *c*) schematically illustrate prior art examples of loudspeakers 26 in an enclosure 30. FIGS. 6 *b*) and *d*) exemplarily illustrate examples of loudspeakers 26 in a frontal waveguide arrangement that further comprises a waveguide on a frontal side of the loudspeaker 26. The frontal waveguide 32 may be formed by wall portions of a cavity within the frame 15. Although the examples illustrated in FIGS. 6 *b*) and *d*) illustrate the frontal waveguides in front of the front side of the loudspeaker 26, a frontal waveguide may also be arranged at the rear side of the loudspeaker 26 (not illustrated in FIG. 6). A waveguide generally includes an output 42 through which the sound may exit the waveguide 32. If such a waveguide output 42 is the only free air path the sound may travel from the loudspeaker 26 towards the ear of a user, the waveguide is generally referred to as frontal waveguide. If a waveguide is arranged both at the front side and at the rear side of a loudspeaker 26, the waveguide 32 which has its output 42 closer to the entry of the ear canal of the user (free air path) is referred to as frontal waveguide. Alternatively, frontal waveguides may be defined by their position relative to the ear of the user when the ear cup 14, comprising the waveguide arrangement within a frame 15, is arranged around the ear of the user. In this case, the waveguide output of a frontal waveguide adjoins the open volume about the ear of the user defined by the ear cup 14. The waveguide output of a rear waveguide opens towards free air outside the ear cup 14. However, in the following, whenever a sound source arrangement is described as having a frontal waveguide, the frontal waveguide is arranged in front of the frontal side of at least one loudspeaker 26.

Referring to FIGS. 6 *a*) and 6 *c*), sound of the loudspeakers 26 is radiated into free air by a complete loudspeaker membrane 262. No sound, however, is radiated into free air from the rear side of the loudspeaker 26 because the loudspeaker 26 illustrated in FIG. 6 is arranged in a closed enclosure 30. Referring to FIGS. 6 *b*) and 6 *d*), a frontal waveguide 32 is arranged in front of the loudspeaker membrane 262. The frontal waveguide 32 includes at least one wall that is arranged in front of the loudspeaker membrane 262. The frontal waveguide 32 may be formed by wall portions of the frame 15. A first distance d1 between the wall and the loudspeaker membrane, as is schematically illustrated in FIG. 6 *e*), may be smaller than the largest diameter or largest diagonal of the membrane 262 of at least one loudspeaker 26 coupled to the waveguide 32. For example, the first distance d1 may be less than 15 mm, less than 5 mm, or less than 3 mm. The first distance d1 may be less than 60%, less than 40% or less than 30% of the largest diameter or largest diagonal of the membrane 262 of the respective loudspeaker 26. The first distance d1 may also depend on the highest wavelengths radiated by the loudspeaker 26. For example, the first distance may be less than a full wavelength, less than five times a wavelength, or less than ten times a wavelength of the sound that is radiated by the loudspeaker. The first distance d1, or more generally speaking, a cross-sectional area of the waveguide chamber, however, may vary over a dimension of the waveguide chamber. For example, the distance d1 or cross-sectional area may increase linearly or exponentially from a point remote to the waveguide output 42 (e.g., to at an opposite end of the waveguide) towards the waveguide output 42. Parts of the wall of the waveguide 32 may overlap with parts of the user's pinna when an ear cup comprising the waveguide arrangement is arranged around the ear of a user. The waveguide 32 is formed by wall portions of a second cavity 34 in front of the loudspeaker membrane 262 which, in the following, will also be referred to as waveguide chamber 34. The waveguide 32 comprises at least one opening 42 through which sound may exit the waveguide chamber 34. The size, shape and position of the opening 42 may be chosen appropriately for a given application.

A waveguide opening 42 or waveguide output may, for example, have a circular, oval, rectangular, triangular, or radial shape. Any other regular or irregular shape is possible.

A waveguide 32 or waveguide chamber 34 may comprise exactly one opening which forms the waveguide output 42. However, it is also possible that one waveguide 32 or waveguide chamber 34 may comprise two or more openings which together form a waveguide output 42 with a combined cross-sectional area and with an average position with respect to other features of the frame 15 or the ear of the user. In the following, if reference is made to a waveguide output 42, this refers to waveguide outputs including only one opening as well as to combined outputs including more than one opening. However, a waveguide output 42 may be arranged such that it is on average significantly closer to the entry of the ear canal of a user than the membrane 262 of the at least one loudspeaker 26 when the frame 15 including the waveguide arrangement is arranged around the ear of a user. An average distance between a waveguide output 42 and the ear canal of a user may be at least 30%, at least 40% or at least 60% shorter than an average distance between the membrane 262 of the loudspeaker 26 and the ear canal of the user, when the frame 15 including the waveguide arrangement is arranged around the ear of a user. An average position of a single or a combined waveguide output with respect to the concha area of a user's ear may deviate from an average position of the membrane of the at least one loudspeaker 26 with respect to the concha area of a user's ear by more than 10°, more than 20°, or more than 30°, when the frame 15 including the waveguide arrangement is arranged around the ear of a user. However, a surface area of the frontal waveguide 32 may be at least 50%, at least 70%, or at least 90% of the surface area of the loudspeaker membrane 262, thereby covering at least 50%, at least 70% or at least 90% of the loudspeaker membrane 262.

The waveguide 32 is configured to control a sound output position with respect to the ear of the user in order to move the sound source virtually closer to the ear and to control the incidence angle at the ear. Part of the enclosed air volume within the waveguide chamber 34 and an air volume in a region close to the output 42 of the waveguide 32 may form a Helmholtz resonator. The resonance frequency of the Helmholtz resonator may depend on the internal volume of the waveguide chamber 34 as well as on the cross sectional area of the waveguide output 42. Below the Helmholtz resonance frequency, air within the waveguide chamber 34 may move essentially homogeneously when the waveguide chamber 34 is driven by at least one loudspeaker. As an advantageous side effect, the mass of the air inside the waveguide chamber 34 may add to the total moving mass of the loudspeaker 26 if the waveguide chamber 34 is sufficiently small. This may, in turn, lower the effective resonance frequency of the loudspeaker 26 arranged within the waveguide chamber 34. At the Helmholtz frequency, part of the air volume within the waveguide chamber 34 may form an air spring, which contracts and expands during resonation. Another air volume partly inside the waveguide chamber 34 and partly outside, close to the output 42 of the waveguide chamber 34, may form a mass that resonates with the air spring. At and below the Helmholtz resonance frequency, air particles in the vicinity of the waveguide chamber output may essentially move homogeneously. These homogeneously moving air particles may form a sound source closer to the ear canal entry of the user than the membrane 262 of the at least one loudspeaker 26 driving the waveguide 32.

A reduced distance of the sound source to the user's pinna or, more specifically, ear canal entry, is especially important for open ear cups as it improves the maximum sound pressure level (SPL) at the ear canal entry for a given loudspeaker 26, particularly at low frequencies. The waveguide 32 should, however, not exclusively be understood as a Helmholtz resonator. Although a resonance according to the Helmholtz resonator principles may occur, the resonance is not required for the essential waveguide function in the context of the invention. It may further be appreciated, that the shape of the volume within the waveguide 32 and around the output 42 of the waveguide 32, at least in some cases, may not allow for a clear allocation to an inner volume and a volume within a duct that connects the inner volume to the outside. Therefore, resonances that may occur within the waveguide 32 may not necessarily be classified as Helmholtz resonance. The lowest resonance frequency occurring within the waveguide volume may also depend on the longest internal dimensions of the waveguide chamber 34. Furthermore, additional resonances may occur at higher frequencies that may depend on shorter internal dimensions. The waveguide 32 may be utilized at any frequency to guide sound emitted by at least one loudspeaker 26 to a position that is closer to the ear canal entry of the user or arranged at a certain position with respect to the ear of the user or both. Thereby, the air volume into which sound that is generated by the at least one loudspeaker 26 within the waveguide chamber 34 expands until it reaches the ear canal entry of the user, may be reduced significantly as compared to the case without a waveguide 32. This may result in an increase of sound pressure level at the ear canal entry. In order to restrict the air volume into which sound that is generated by the at least one loudspeaker 26 within the waveguide chamber 34 expands until it reaches the ear canal entry, the single or combined output 42 of the waveguide 32 may be positioned close to the ear canal entry as mentioned earlier.

Furthermore, a solid angle Q subtended at the geometric or acoustic center of the membrane 262 of at least one of the at least one loudspeaker 26 within the waveguide chamber 34 or the geometric center of the waveguide chamber 34 by either the area of a single waveguide output 42 of the waveguide 32 or the total area within the smallest outline comprising all outputs of a combined waveguide output 42 of the waveguide 32, may be less than $\pi$ steradian or less than $\pi/2$ steradian. The solid angle $\Omega$ subtended by the area of a waveguide output 42 or more general a first surface area may be defined as a second surface area of a unit sphere covered by the projection of the first surface area onto the unit sphere in a direction from the point at which the solid angle $\Omega$ subtends (e.g. the geometric or acoustic center of the membrane 262 of at least one of the at least one loudspeaker 26 within the waveguide chamber 34) towards the surface area. In other words, sound generated by at least one of the at least one loudspeaker 26 within the waveguide chamber 34, may essentially (besides parts of the sound radiated into the waveguide chamber) be radiated into a solid angle of less than $\pi$ steradian or less than $\pi/2$ steradian, at the point where it reaches the single or combined waveguide output 42. Above the Helmholtz resonance frequency, sound pressure levels at the ear canal entry may not increase as compared to the case without waveguide, or eventually even decrease as the air volume within the waveguide chamber 34 may cause a low-pass or attenuating high-shelve behavior of the waveguide. Typically, small loudspeakers are able to produce higher sound pressure levels at high frequencies than at low frequencies. Therefore, adequate equalizing may compensate losses in sound pressure level at high frequencies. Independent from open or closed ear cup implementations, the incidence angle of sound at the pinna can be used to induce directional cues by excitation of natural pinna resonances. For this purpose, the waveguide output 42 may be positioned such that the desired sound incidence angle at the pinna is achieved. It should be noted, that the size increase between the arrangements of FIGS. 6 *a*) and b) and between the arrangements of FIGS. 6 *c*) and d) may be compensated at least partially by any kind of protective grille that is usually required to protect the otherwise open loudspeaker membranes 262 of the arrangements of FIGS. 6 *a*) and *c*) in an actual product.

For precise control of the location of a waveguide output 42 relative to a user's ear and for effective focusing of a loudspeaker output close to the ear canal entry of a user, the cross sectional area of the waveguide output 42 may be chosen to be comparably small. Aside from effects, this may have on a Helmholtz resonance within the waveguide chamber 34, waveguide outputs 42 that are too small may cause sound pressure level reduction and signal distortion. For a given loudspeaker 26 within a waveguide 32, a sound pressure loss IL in dB, caused by the waveguide output 42 may be approximated as IL=0.01*(Vd/Aw)^2+0.001*(Vd/Aw), where Vd is a volume displacement (e.g. maximum volume displacement) of the loudspeaker membrane 262 and Aw is the cross sectional area of the waveguide output 42. For example, a volume displacement Vd of 200 $mm^3$ and an output cross sectional area Aw of 40 $mm^2$ result in an approximated sound pressure loss of about 0.25 dB. In order to keep distortion low, the approximated sound pressure loss IL may be lower than 0.5 db or lower than 0.75 dB.

Figure 7:
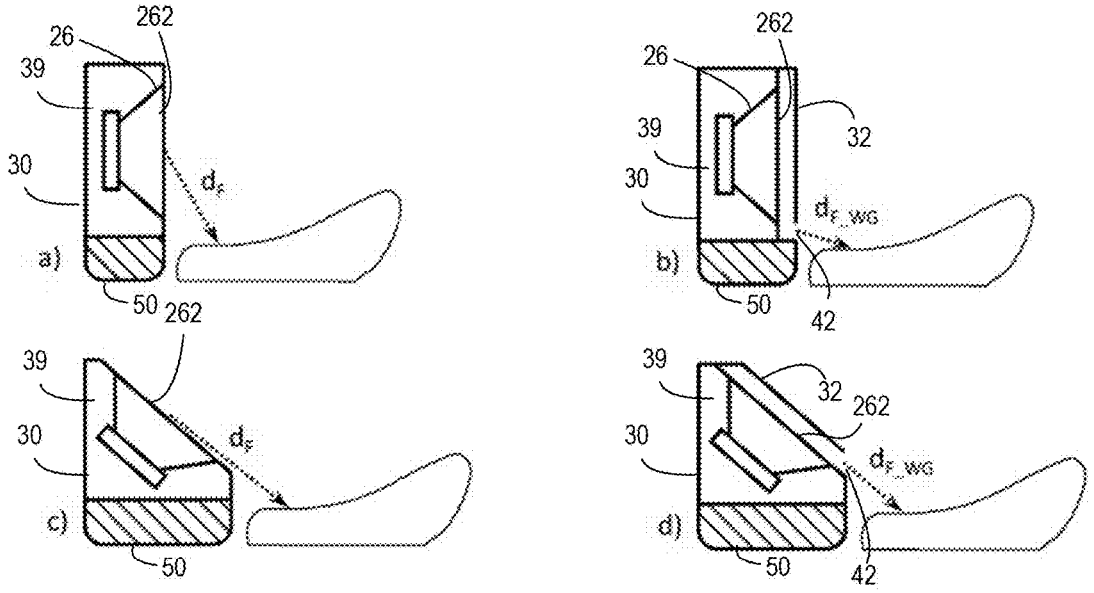
FIG. 7, including FIGS. 7 *a*) to *d*), schematically illustrates average distances between different sound source arrangements and an entry of a user's ear canal.

The afore mentioned is exemplarily illustrated in FIG. 7, which schematically illustrates an average distance (dF) between the loudspeaker 26 and the entry of the ear canal of a user's ear for the examples of FIGS. 6 *a*) and *c*) as well as an average distance (dF_WG) between the waveguide output 42 and the ear canal entry for the exemplary loudspeaker or sound source arrangements of FIGS. 6 *b*) and *d*). The low frequency SPL increase between the arrangements of FIGS. 6 *a*) and *c*) and the examples including a frontal waveguide 32 of FIGS. 6 *b*) and *d*) may be approximated as AWG=20*log 10 (dF/dF_WG), which equals +5.3 dB for b) versus a) and +5.7 dB for d) versus c). This approximation assumes 6 dB SPL decrease for a doubling of source distance, which may not be accurate for positions in close proximity to the source (e.g., at a distance of less than 3 cm) and for any complete ear cups 14 incorporating the loudspeaker enclosure and/or waveguide constructions 32 as illustrated in FIG. 7. Depending on the waveguide dimensions and the shape of the waveguide 32, the approximation may work fairly well up to a few hundred Hertz or even several Kilohertz. Especially, comparing the arrangement of FIG. 7 *a*) with the example of FIG. 7 *b*), a change in average sound incidence angle at the concha region, introduced by the waveguide, may also be observed.

Figure 8:
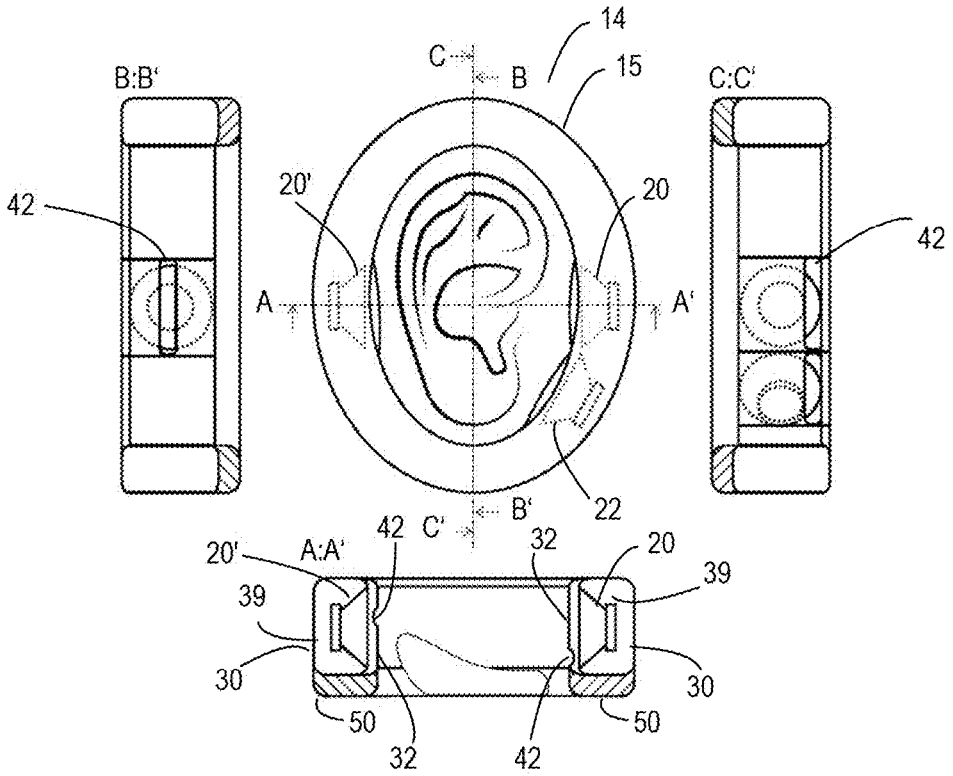
FIG. 8 schematically illustrates a further example of an ear cup.

An exemplary ear cup implementation containing multiple frontal waveguides, which otherwise corresponds to the arrangement without waveguides as illustrated in FIG. 4, is illustrated in FIG. 8. The arrangement illustrated in FIG. 8 comprises an ear cup 14 comprising a frame 15 and loudspeakers 20, 20', 22 that are arranged within the frame 15. In the example of FIG. 8, two loudspeakers 20, 22 are arranged in front of the user's ear, while one loudspeaker 20' is arranged behind the user's ear. A waveguide 32 is arranged in front of each of the loudspeakers 20, 20', 22. That is, all loudspeakers 20, 20', 22 radiate sound into separate waveguide chambers in front of their membranes 262 (see FIG. 7). Each waveguide chamber has a separate waveguide output 42. As is exemplarily illustrated in FIG. 8, the waveguide outputs 42 may have the form of slits which extend over the complete width of the respective loudspeaker 20, 20', 22. These outputs or slits 42 are positioned at different distances from the user's head when the open ear cup is placed around an ear of the user 2. Multiple adjacent waveguide outputs 42 may form a continuous waveguide output.

For example, the sound outputs 42 of the waveguides of loudspeakers 20, 22 in front of the pinna are closer to the head than the output 42 of the waveguide of loudspeaker 20' behind the pinna. This enables direct sound propagation towards the concha region of the user's pinna for front and rear waveguide outputs. Especially for the rear loudspeaker 20', the position of the waveguide output 42 avoids shading of the sound radiated to the concha by head-facing parts of the outer ear.

Figure 9:
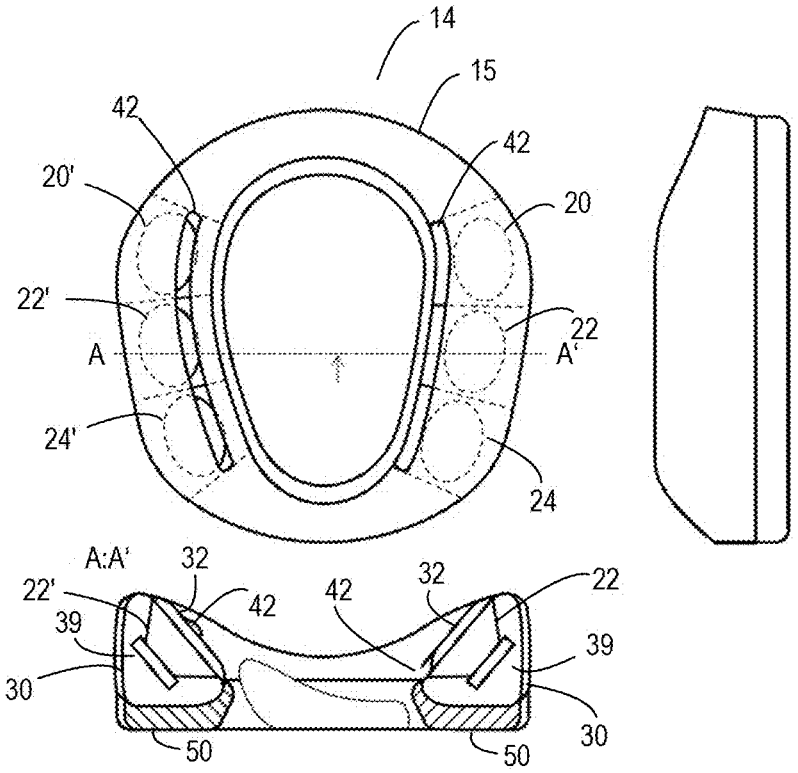
FIG. 9 schematically illustrates a further example of an ear cup.

FIG. 9 exemplarily illustrates another example of frontal waveguides 32 integrated in the frame 15 of an open ear cup 14. Except for the frontal waveguides 32, the arrangement is otherwise identical to the arrangement illustrated in FIG. 5. Similar to the previous example including a frontal waveguide 32, all six loudspeakers 20, 20', 22, 22', 24, 24' that are illustrated in FIG. 9 are arranged within individual closed rear chambers 30 and comprise separate waveguide chambers in front of their membranes 262 (see FIG. 7). Only the waveguide output 42 of the waveguides 32 allows for a sound pressure exchange with free air outside the waveguide chamber. The waveguide outputs 42 of the waveguides 32 each comprise a slit in the respective waveguide 32, wherein the slit has a width which approximately equals the width of the separate loudspeakers 20, 20', 22, 22', 24, 24'. Neighboring waveguide outputs 42 may merge into each other such that they form an almost continuous combined sound output along the front and/or rear side of the pinna, respectively. As has been described above, waveguide outputs 42 are positioned purposefully to avoid acoustic shading between sound outputs 42 and the concha region of the user's ear.

Figure 10:
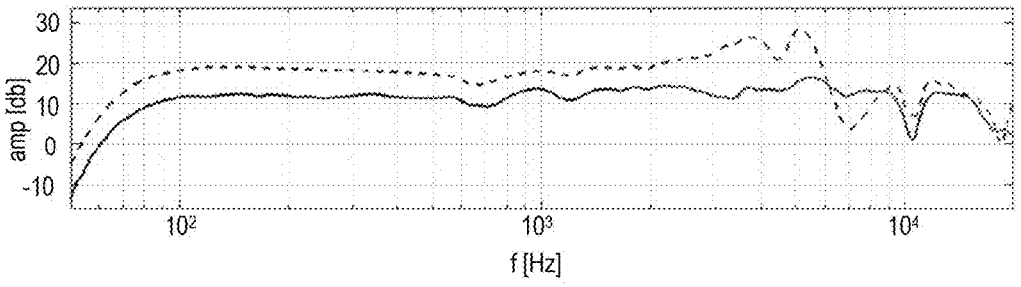
FIG. 10 schematically illustrates examples of sound pressure measurements over frequency for different ear cups.

To further illustrate examples of improvements that are possible with the proposed frontal waveguide 32, FIG. 10 exemplarily illustrates measurements of actual amplitude responses that were measured with a dummy head without pinnae and a microphone positioned at a typical position of a user's concha region. The solid line represents amplitude responses that were measured with an arrangement without frontal waveguide, and the dashed line represents amplitude responses that were measured with an arrangement with a frontal waveguide 32. The ear cups that were used for the measurements were similar to the ear cups 14 as illustrated in FIG. 5 and as illustrated in the embodiment with frontal waveguides 32 of FIG. 9. Both measurements where performed with an equal excitation signal which contained filters to equalize the amplitude response of the arrangement of FIG. 5. In the present example, the SPL is increased by at least 6 dB between 50 Hz and 6 kHz. Below 50 Hz (not shown in FIG. 10), the same SPL increase was observed. To achieve this increase of SPL by loudspeaker adaptions, a doubling of air volume displacement of the loudspeaker membranes 262 would be required, which could, for example, be achieved by a doubling of the number of similar loudspeakers as well as a doubling of the membrane area or a doubling of the excursion of the existing loudspeakers.

The measurements illustrated in FIG. 10, however, only represent one possible example. Depending on the exact implementation of the waveguides 32, a higher SPL increase and/or a wider bandwidth of the frequency region with consistent SPL increase are possible. SPL will generally increase with decreasing distance to the waveguide output 42. Therefore, SPL for the user will increase the closer the waveguide output 42 is arranged to his ear canal and waveguides may be designed accordingly.

Figure 11:
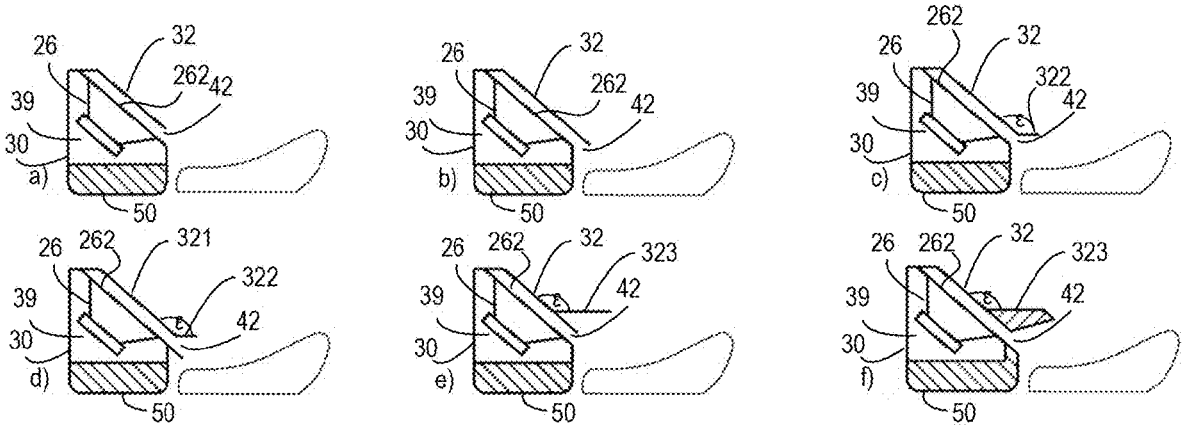
FIG. 11, including FIGS. 11 *a*) to *f*), schematically illustrates different examples of to sound source arrangements with frontal waveguides.

FIG. 11 exemplarily illustrates several examples of frontal waveguides 32 that extend from in front of the loudspeaker 26 further towards the ear canal entry in order to increase the SPL at this position. FIG. 11 *a*) exemplarily illustrates an example of a waveguide 32, wherein the waveguide 32 essentially covers the loudspeaker membrane 262. In the examples illustrated in FIGS. 11 *b*) to d) the waveguide is extended, that is, the waveguide 32 extends beyond the surface area of the loudspeaker membrane 262 in the direction of the user's ear. The waveguide 32 may be essentially flat, as is illustrated in FIGS. 11 *a*) and b). In the examples of FIGS. 11 *c*) and d), the waveguide 32 comprises a first part 321 and a second part 322, wherein the second part 322 is arranged at an angle ε to the first part 321, wherein ε<180°. The second part 322 is coupled to a first end of the first part 321. In the example illustrated in FIG. 11 *e*), the waveguide 32 comprises a protrusion 323. The protrusion 323 forms a kind of roof above the waveguide outlet 42. Similar to the arrangements of FIGS. 11 *c*) and d), the protrusion 323 forms an angle ε with the waveguide 32, wherein ε<180°. The protrusion 323 is arranged between the first end and a second end of the waveguide 32. The roof formed by the protrusion 323 reduces the volume into which the sound wave from the waveguide output 42 expands until it reaches the ear canal entry. Thereby, the SPL reduction per distance from the waveguide output 42 is lowered. The protrusion 323 illustrated in FIG. 11 *e*) includes a thin plate. In the example illustrated in FIG. 11 *f*), the protrusion 323 includes a thicker plate or wedge. The protrusion 323 of FIG. 11 *f*) includes sound absorbing material. For example, a wedge of sound absorbing material may be mounted to a bottom side of the plate that is illustrated in FIG. 11 *e*). The sound absorbing material helps to reduce reflections from otherwise reflective surfaces into the concha.

A flatness of the amplitude response of the waveguide 32 depends on geometrical features of the waveguide 32. As has been described before, part of the enclosed air in the waveguide chamber and air in the area close to the output 42 of the waveguide 32 may form a resonator (e.g., Helmholtz resonator) for which the resonance frequency as well as the quality factor may, amongst other options, be adjusted by adaption of the internal volume of the waveguide chamber as well as by an adaption of the cross sectional area of the waveguide output 42. A typical Helmholtz resonator contains an internal volume and an air duct with defined cross section and length. In the waveguide examples of FIG. 6, which comprise internal volumes of largely consistent height (distance between waveguide wall and loudspeaker baffle), about one quarter of the depth (between waveguide output 42 and a rear waveguide wall) may be accounted for the duct and about three quarters of the depth may be accounted for the internal volume to approximately calculate the Helmholtz resonance frequency and Q-factor as commonly known. This assumes that the width of the waveguide chamber and, therefore, the cross sectional area is largely consistent over the complete chamber depth and equal to the width of the output 42.

For different, more complex shapes of the internal waveguide chamber 34, other relations may apply between geometrical features and Helmholtz resonance parameters. Different waveguide shapes may in any case be evaluated by measurements. Generally, it can be said that the smaller the internal waveguide volume and the larger the output cross section area, the higher the Helmholtz resonance frequency and the smaller the quality-factor of the resonance. The lower the quality factor, the better the resonance magnification of the waveguide output amplitude may be equalized with filters that affect the loudspeaker signal. The higher the resonance frequency, the more effective it may be damped with damping material and the less audible it will be. As, in most cases, it is usually desirable to keep the waveguide dimensions and thereby the complete ear cup 14 as small as possible, the relation between internal waveguide volume and resonance frequency is generally advantageous as it allows waveguides 32 that are comparable in size to typical protective grilles that are often required to protect otherwise open loudspeaker membranes 262. In some embodiments, the internal volume of a frontal waveguide 32 may be less than two times, less than four times or less than eight times the maximum volume displacement of the loudspeaker membrane 262 of all of at least one loudspeaker 26 arranged within the waveguide. A further option to decrease the quality factor is the introduction of damping material or a material providing acoustic resistance to the waveguide chamber or to the outlet 42. Depending on the density of the damping material, the waveguide's Helmholtz resonance may be damped while lower frequency signals are left almost unaltered.

Because internal reflections and resonances (internal meaning internal to the waveguide structure) usually occur at relatively high frequencies (depending on the to waveguide dimensions), especially for loudspeakers 26 covering a lower frequency region, the corresponding waveguide outputs 42 may be arranged remote from the at least one driving loudspeaker 26. It may be beneficial to place frontal waveguide outputs 42 close to the ear canal entry in order to get the highest possible SPL. Positions around the pinna closest to the ear canal entry are in front of the pinna. Therefore, this is a good output position for frontal waveguides 32 concerned with low frequency playback. For example, one or more loudspeakers 26 may be arranged around the pinna with a single frontal waveguide 32 and the output 42 of the waveguide 32 may not be in front of one or all loudspeakers 26 but laterally disposed from the loudspeakers 26 in front of the pinna.

Reflections inside the waveguide chamber 34 constitute another source for amplitude variations. Such reflections inside the waveguide chamber 34 may interfere with the direct loudspeaker signal (sound radiated by the loudspeaker 26 before hitting a wall) within the waveguide chamber 34 or at the waveguide output 42 and may, depending on a relative acoustic phase between both signals (direct signal and reflected signal), sum up positively with the direct signal or cancel it out. These effects usually occur for frequencies for which at least half a wavelength fits into at least one dimension (e.g., height d1, depth d2, or width) of the waveguide chamber 34. Reflections inside the waveguide chamber 34 may be reduced by avoiding reflective surfaces that point towards the central area (e.g., geometrical center $C_W$ of the waveguide chamber 34) or towards the output 42 of the waveguide chamber 34. Reflection-based summation and cancellation effects may also be deliberately distributed over a larger frequency range by distance variations between internal waveguide walls and the geometrical waveguide center as well as the waveguide output. This is schematically illustrated in FIGS. 6 *f*) and g). In FIG. 6 *f*), the geometrical center $C_W$ of the waveguide chamber 34 is schematically illustrated. A distance $d_{CW1}$ between a first wall of the waveguide chamber 34 and the geometrical center $C_W$ differs from a distance $d_{CW2}$ between another wall of the waveguide chamber 34 and the geometrical center $C_W$. Further, as is schematically illustrated in FIG. 6 *g*), an exemplary distance $d_{OUT1}$ between a first wall of the waveguide chamber 34 and the output 42 is greater than a distance $d_{OUT2}$ between a second wall of the waveguide chamber 34 and the output 42. These distances may, for example, be designed to vary within the range between the largest internal dimension and half the wavelength of the highest frequency of interest (e.g. 15-20 kHz). Distance variations may, for example, be accomplished by the distribution of the waveguide walls. It is also possible to introduce geometric objects right within the waveguide chamber 34 that vary the distance of unblocked paths in different directions through the waveguide chamber 34. Any distances smaller than half the wavelength of the highest frequency of interest (e.g. distance waveguide wall to loudspeaker baffle and/or membrane 262) are usually not of concern in the given context. In addition, internal reflections may be reduced with damping material inside the waveguide chamber 34.

The examples described above shall not restrict the scope of the invention. Especially the number of loudspeakers per ear cup, the loudspeaker placement or the waveguide and ear cup geometry may differ from the examples shown above. Examples merely aim to illustrate the basic concept of frontal waveguides.

A general issue for the generation of low frequency acoustic signals is the increase of required air volume displacement for a given sound pressure level towards decreasing frequencies. For loudspeakers, the air volume displacement may be raised by an increased membrane excursion or membrane size. Stability of membrane 262 and voice coil motion usually limits excursion for a given loudspeaker size. Increase of membrane area for a given loudspeaker results in increase of system resonance within an enclosure. If a loudspeaker with a given free air resonance frequency is mounted within a closed box, it may exhibit a resonance frequency shift towards a multiple of the free air resonance. Operation of the loudspeaker 26 at frequencies below the resonance frequency usually requires high driving signal levels that may not be feasible due to limitations in the driving hardware or the loudspeaker itself.

Therefore, the sound pressure generated by the rear side of the loudspeaker membrane 262 may be released into free air. This can avoid the increase of the loudspeaker's resonance frequency or even decrease the same when the loudspeaker 26 is built into the enclosure 30. Opening the rear enclosure 30 results in a dipole configuration or arrangement, where sound with inverse polarity from the front and the back of the loudspeaker membrane 262 is radiated into free air. At low frequencies an additional phase shift caused by the distance sound may travel across the typical dimensions of an ear cup will be negligible, so that the frontal and rear signal cancel each other out if the signal amplitude is equal. This may become a problem for open ear cups, for which the rear sound is free to propagate towards the ear of the user, where it may cause sound pressure losses, referred to as dipole losses in the following. To solve this, a rear dipole waveguide is proposed, that controls the position of rear sound radiation into free air in order to decrease attenuation of frontal loudspeaker sound by sound emitted by the rear of the loudspeaker 26 at the position of the user's ear canal entry.

Figure 12:
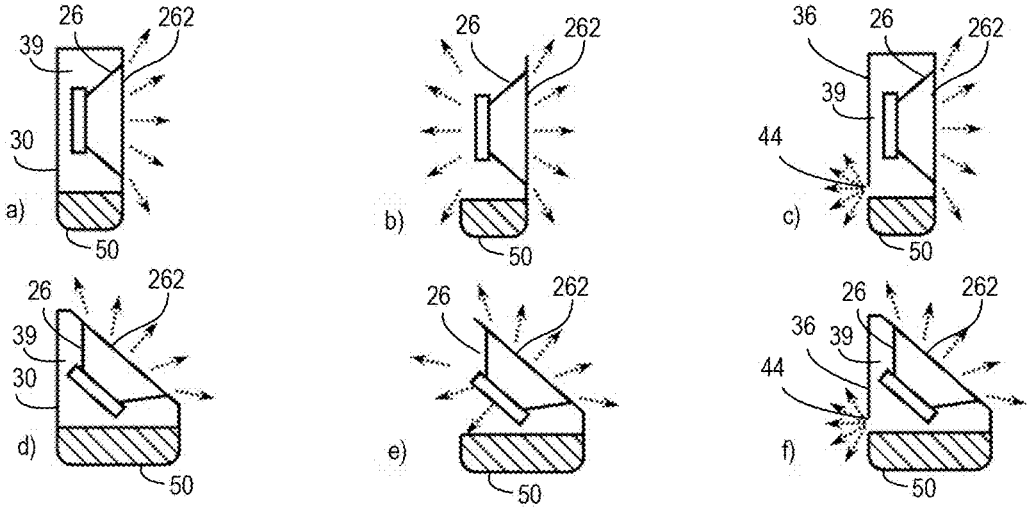
FIG. 12 schematically illustrates different sound source arrangements with or without a rear waveguide.

In FIG. 12, FIGS. 12 *a*) and d) schematically illustrate a loudspeaker 26 without a frontal waveguide and arranged in a completely closed rear enclosure 30. In the examples illustrated in FIGS. 12 *b*) and e), the rear enclosure walls have been removed, to obtain simple dipole loudspeakers. Referring to FIGS. 12 *c*) and f), rear (dipole) waveguides 36 are schematically illustrated. The term "dipole waveguide" in this context shall emphasize that the resulting sound source arrangement including the at least one loudspeaker 26 surrounded by wall portions of the rear waveguide and the rear waveguide 36 exhibits a radiation pattern similar to a dipole loudspeaker, although the frontal and rear radiation lobes may be asymmetric. Similar to the frontal waveguide 32 that has been described above, the rear waveguide 36 is arranged behind the loudspeaker 26, but may also be arranged in front of the loudspeaker. The rear waveguide 36 may be formed by wall portions of a frame 15 of an ear cup 14. The rear waveguide 36 is formed by wall portions surrounding an open cavity 39 at the back of the loudspeaker 26. The rear waveguide 36 comprises at least one waveguide output 44 through which sound may exit the waveguide 36. For the sake of simplicity, parts of the rear wall of the corresponding examples of FIGS. 12 *a*) and d) serve as wall portions for the rear dipole waveguide 36 of FIGS. 12 *c*) and f). That is, an waveguide output 44 is provided for the enclosure 30 of FIGS. 12 *a*) and d). In other words, the rear walls contain a waveguide output 44 right above the cushion (hatched areas in FIG. 12). The enclosure 30 may be formed by a cavity 39 within a hollow frame 15 of an ear cup 14, for example. It is, however, important to note that the internal air volume of the closed box 30 of the arrangements of FIGS. 12 *a*) and d) is not required for the rear dipole waveguide 36 of the arrangements of FIGS. 12 *c*) and f). For the latter examples, the waveguide walls may also follow the rear loudspeaker outline closely with only a narrow slit between loudspeaker and waveguide wall for air exchange. This is one of the advantages of the proposed rear dipole waveguide, as the overall size of the ear cup may be considerably smaller than for known solutions.

Figure 13:
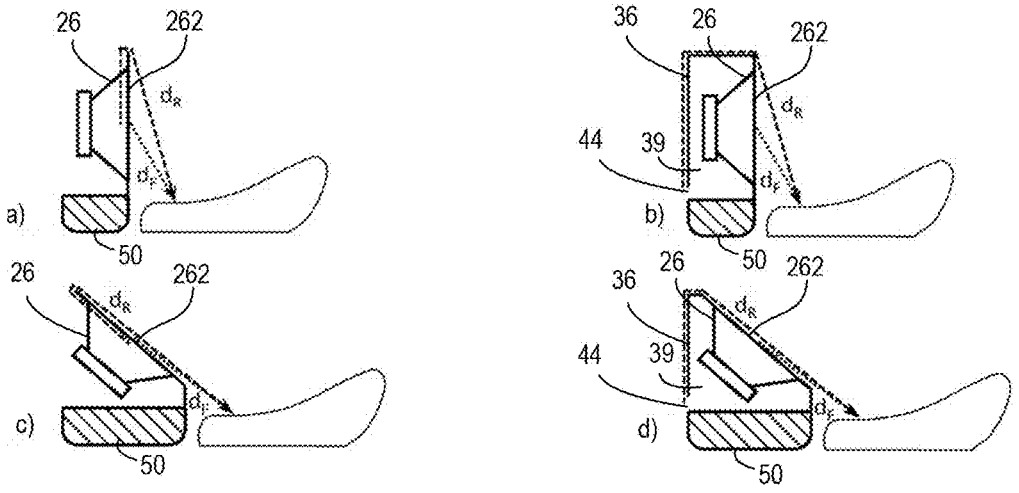
FIG. 13, including FIGS. 13 *a*) to *d*), schematically illustrates average distances between different sound source arrangements and an entry of a user's ear canal.

In order to illustrate the advantages of the rear dipole waveguide 36, FIG. 13 exemplarily illustrates the average distance (dF) between the front of the loudspeaker 26 and the entry of a user's ear canal, and the average distance (dR) between the rear of the loudspeaker 26 and the entry of the user's ear canal. As has been mentioned before, sound emitted by the front of the loudspeaker 26 may be cancelled by sound emitted from the rear of the loudspeaker 26 if the amplitude of both sounds is equal and their phase inversed. The latter is generally the case for low frequencies for which the wavelength is much longer than any distance of a typical ear cup. In order to reduce a cancellation of sound at the entry of the user's ear canal, the rear dipole waveguide 36 may comprise a waveguide output 44 which is located distant to the entry of the user's ear canal. Therefore, the waveguide outputs 44 of the examples illustrated in FIGS. 13 *b*) and *d*) are located at the outside of the frame 15 (not facing the ear) right above the cushion. It should be noted, that rear waveguide outputs 44 may generally be located at any position around the external circumference of the ear cup in order to maximize the distance between the output 44 and the entry of the user's ear canal. For example, a remote rear waveguide output may be located above the pinna for one or multiple loudspeakers located at different positions around the pinna (e.g., in front of the pinna). It is generally not required to position the output 44 close to and/or behind the loudspeaker 26. Long waveguide lengths, however, may cause internal resonances and reflection effects that may be detrimental for frontal sound. Nevertheless, remote rear waveguide outputs 44 may be applied to the low frequency branch of multi-way systems as well as to full range loudspeakers in order to maximize low frequency sound pressure level. The acoustic cancellation of the examples in FIG. 13 as compared to a closed box (FIGS. 12 *a*) and d)), may be approximated as ADP=20*log 10(1−dF/dR). A 6 dB SPL decrease per doubling of distance between the loudspeaker 26 and the entry of the user's ear canal is assumed by the approximation, which may not be very accurate in close proximity to the loudspeaker and within complete ear cup structures containing the loudspeaker and enclosure assemblies illustrated in FIG. 13. With the exemplary distances of FIG. 13, the approximation equals dipole losses of −3.9 dB for the example of FIGS. 13 *a*) and −2.4 dB for the corresponding rear dipole waveguide 36 of the example of FIG. 13 *b*). For the example of FIG. 13 *c*), the approximation result is −4.9 dB and for the example of FIG. 13 *d*) −4 dB. It can be seen that the rear dipole waveguide 36 reduces acoustic cancellation at the ear canal entry in both of the given examples, although the improvement is generally quite small, which may be different for other loudspeaker orientations (e.g. membrane parallel to the median plane).

A dipole configuration or arrangement, as is illustrated in FIGS. 12 *c*) and f), for example, may enable a larger loudspeaker membrane area within the same ear cup size as compared to a closed box implementation. In practical devices, voltage, current or power that are available to drive the loudspeaker 26 may be limited. Furthermore, the power handling of the loudspeaker 26 may limit power that can safely be applied. Therefore, a maximum membrane size can be limited for closed box implementations, as larger membranes require increased enclosure volume, which may in turn increase ear cup size. As long as the increase of SPL caused by an increase of membrane area in a dipole configuration or arrangement as compared to a closed box configuration or arrangement exceeds the acoustical cancellation losses, the dipole will provide an overall SPL increase. In addition, closed boxes with small air volumes tend to generate high intermodulation distortion, which may be improved with the proposed dipole configuration or arrangement with rear waveguide 36.

Figure 14:
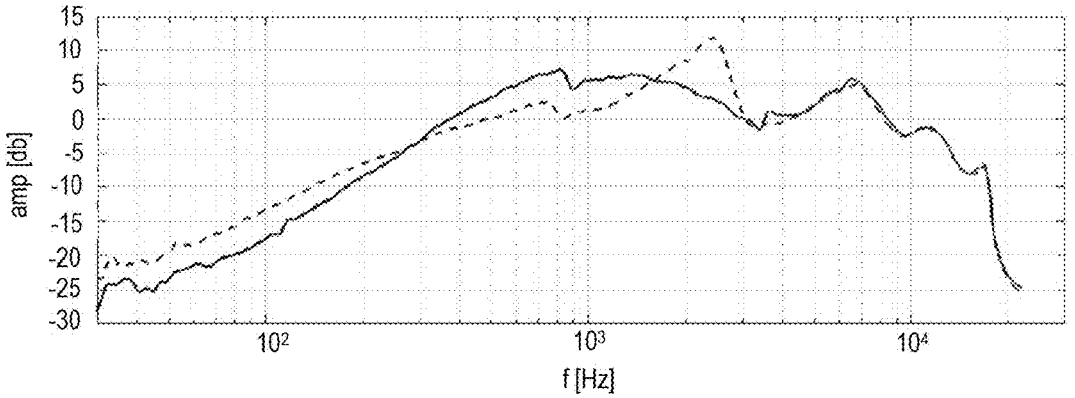
FIG. 14 schematically illustrates examples of amplitude responses over frequency for different ear cups.

FIG. 14 illustrates exemplary measurements of amplitude response over frequency for a closed box arrangement similar to the arrangement of FIG. 12 *a*) (solid line), and for a dipole loudspeaker arrangement as exemplarily illustrated in FIG. 12 *c*) (dashed line). As can be clearly seen in FIG. 14, a dipole arrangement comprising a rear waveguide 36 may provide more SPL at low frequencies (e.g. below 250 Hz) than a closed box arrangement when measured with the same test signal and at the same microphone position (typically at the position of the concha, assuming the ear cup is worn by a user).

Dipoles generally tend to generate higher harmonic distortion at low frequencies. This is because of the partial cancellation of sound by acoustic short circuit (180° phase shifted sound output by rear of loudspeaker 26 cancels sound output by front of loudspeaker 26), as has already been described above. As has been described, the extent of the cancellation can be reduced locally by controlling the distance between the sound output at the rear of the loudspeaker 26 into free air and the location of interest (e.g. the user's ear canal entry). Nevertheless, there may still be a trade-off between required power for a certain SPL (low frequency sensitivity) and loudspeaker distortion. The waveguide output 44 and/or rear chamber 39 can be stuffed with damping material to control sound output at the rear side and, to therefore, tune the system to the best compromise between dipole and closed box. With various degrees of rear waveguide chamber damping, any compromise between dipole and monopole may be chosen. Damping material may also be beneficial to reduce high frequency output that may otherwise lead to a summation and to cancellation effects at the ear position with corresponding peaks and dips in the frequency response that may be hard to equalize (e.g. at 2.5 kHz in FIG. 14). Generally higher frequencies (e.g. above 1 kHz) show stronger damping effects for typical fiber or foam based damping materials than lower frequencies (e.g. below 200 Hz). Therefore, negative effects in the higher frequency range may be suppressed while keeping the advantages at lower frequencies.

Figure 15:
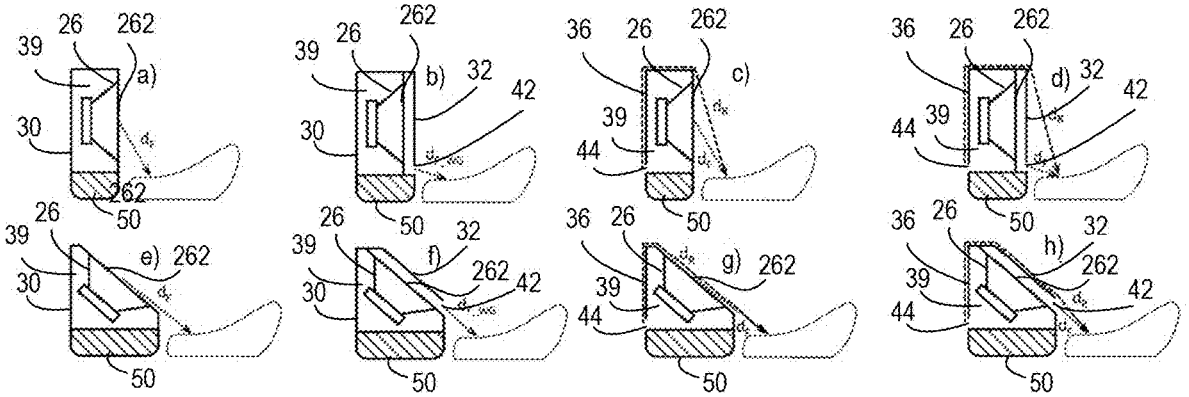
FIG. 15, including FIGS. 15 *a*) to *h*), schematically illustrates average distances between different sound source arrangements and an entry of a user's ear canal.

FIGS. 15 *a*) and e) exemplarily illustrate known closed enclosure loudspeaker arrangements without frontal waveguide. FIGS. 15 *b*) and f) exemplarily illustrate closed enclosure loudspeaker arrangements with frontal waveguide 32. FIGS. 15 *c*) and g) exemplarily illustrate loudspeaker arrangements comprising a rear waveguide 36. Frontal waveguide arrangements and rear dipole waveguide arrangements as have been described above, may also be combined with each other, resulting in a dual waveguide dipole arrangement. This is exemplarily illustrated in FIGS. 15 *d*) and h). The arrangements of FIGS. 15 *d*) and h) comprise a frontal waveguide 32 that is arranged in front of the loudspeaker 26 as well as a rear waveguide 36 that is arranged at the rear of the loudspeaker 26. For the sake of comparability and simplicity, the enclosure dimensions and shapes of the arrangements illustrated in FIG. 15 are largely similar to known frontal waveguide and rear dipole waveguide arrangements.

As described above, the increase in sound pressure level of the frontal waveguide 32 as compared to the closed box arrangement without frontal waveguide may be approximated as AWG=20*log 10 (dF/dF_WG), which equals +5.3 dB for the arrangement of FIG. 15 *b*) as compared to the arrangement of FIG. 15 *a*), and equals +5.7 dB for the arrangement of FIG. 15 *f*) as compared to the arrangement of FIG. 15 *e*). An attenuation of sound pressure in the rear dipole waveguide arrangement as compared to known closed box arrangements without waveguides may be approximated as ADP=20*log 10(1−dF/dR), resulting in −2.4 dB for the arrangement of FIG. 15 *c*) as compared to the arrangement of FIG. 15 *a*), and in −4 dB for the arrangement of FIG. 15 *g*) as compared to the arrangement of FIG. 15 *e*). Dipole losses for dual waveguide arrangements as illustrated in FIGS. 15 *d*) and h) may be approximated with the same formula, namely ADP=20*log 10(1−dF/dR), and the total change in SPL as compared to the arrangements of FIGS. 15 *a*) and e) may thus be approximately calculated as ADWG=AWG+ADP, wherein the AWG is the AWG as has been described with respect to FIG. 15 *b*) or FIG. 15 *f*), respectively. For the dual waveguide arrangement of FIG. 15 *d*), the calculation results in an approximated SPL increase of +4.2 dB as compared to the arrangement of FIG. 15 *a*). For the dual waveguide arrangement of FIG. 15 *h*), an almost equal increase of +3.9 dB as compared to the arrangement of FIG. 15*e*), is obtained by the approximation.

Figure 16:
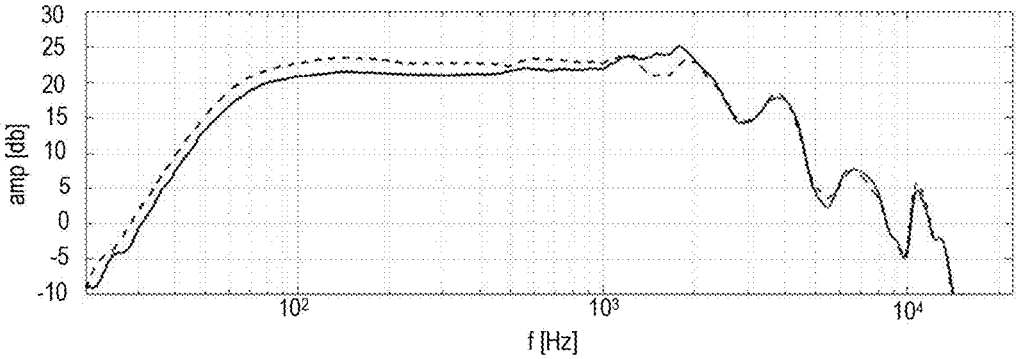
FIG. 16 schematically illustrates examples of amplitude responses over frequency for different ear cups.

The approximated dipole losses of the dual waveguide dipole arrangements are generally considerably lower than for the corresponding rear dipole examples (−1.1 dB for the arrangement of FIG. 15*d*) as compared to −2.4 dB for the arrangement of FIGS. 15*c*), and −1.8 dB for the arrangement of FIG. 15*h*) as compared to −4 dB for the arrangement of FIG. 15*g*)). Therefore, the dipole may be seen as advantageous in the dual waveguide arrangements, as the dipole losses become quite small. Measurement results confirm the waveguide loss approximation for an actual ear cup containing dual waveguide dipole arrangements similar to the arrangement illustrated in FIG. 15*h*). FIG. 16 exemplarily illustrates the measured amplitude response for an ear cup similar to the ear cup 14 as illustrated in FIG. 9 (frame 15 without cover), however, with an additional rear dipole waveguide 36 similar to the rear waveguide 36 of FIG. 15*h*) (solid line). FIG. 16 further exemplarily illustrates the amplitude response of the same ear cup with a remote dipole waveguide output 44 (dashed line). For the remote dipole output measurement, the distance between the rear waveguide outlet 44 and the measurement position (typical position of ear canal entry on a dummy head without ears) was increased drastically by a stable board that was fitted and sealed around the external contour of the ear cup directly above the rear waveguide outlet 44. Thereby the distance between the rear waveguide output 44 and the microphone that was used for the measurements was approximately quadrupled with the corresponding reduction of dipole losses. The measurement results suggest a wideband dipole loss of about −2 dB, which is close to the above approximation of −1.8 dB. The above approximation as well as the measurements shown in FIG. 16 merely include a sound path from the rear waveguide outlet towards the ear canal entry along an external surface of the frame 15 that is not oriented towards the user's head. In other words, a potential sound leak through the cushion between the user's head and the frame 15 has not been included. Such a sound leak may exist and may be reduced by suitable methods in order to reduce corresponding dipole losses.

It should be noted that all approximations with regard to FIG. 15 above concern the acoustic properties with identical loudspeakers 26 and largely identical enclosure sizes. Neither a potential increase of loudspeaker membrane size, nor any low frequency efficiency improvements, both supported by dipole arrangements, have been taken into account. The overall increase of maximum low frequency SPL in an equally sized ear cup may therefore be considerably higher than 4 dB for the dual waveguide dipole arrangement as compared to closed box arrangements without waveguides. If the membrane area, for example, is doubled without an increase of ear cup size, a total maximum low frequency increase in the range of 10 dB may be possible.

Figure 17:
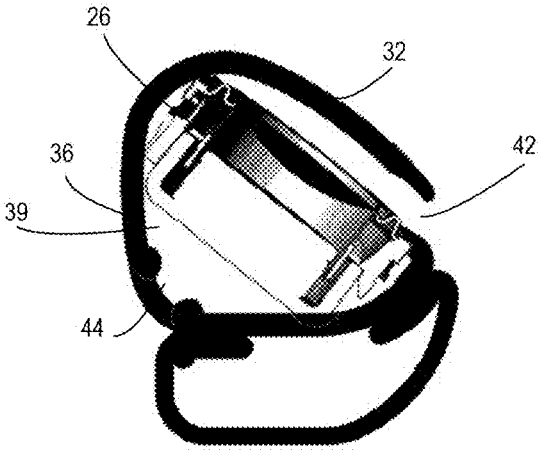
FIG. 17 schematically illustrates a cross-sectional view of a sound source arranged as dual waveguide dipole.

An example of a dual waveguide dipole arrangement is exemplarily illustrated in FIG. 17. The arrangement of FIG. 17 schematically illustrates a possible product implementation and comprises a common micro loudspeaker, as may be used in the exemplary waveguide arrangements.

As has been described above, frontal waveguides 32 as well as rear dipole waveguides 36 may be employed separately or in combination to form dual waveguide dipoles. Although the following examples all show dual waveguide dipoles (comprising front and rear waveguides 32, 36), it should be noted that such arrangements may be simply transformed into frontal waveguide arrangements by closing the rear waveguide output 44 as well as into rear dipole waveguide arrangements by removing the frontal waveguide 32. In addition, it should be noted that waveguide outputs 42, 44 may be arranged at different positions, if required by the respective application. Although the examples of FIG. 18 each include only a single (not more than one) loudspeaker 26, it is also possible to arrange a multiplicity of loudspeakers next to each other, two or more loudspeakers sharing common front and/or rear waveguides 32, 36.

Figure 18:
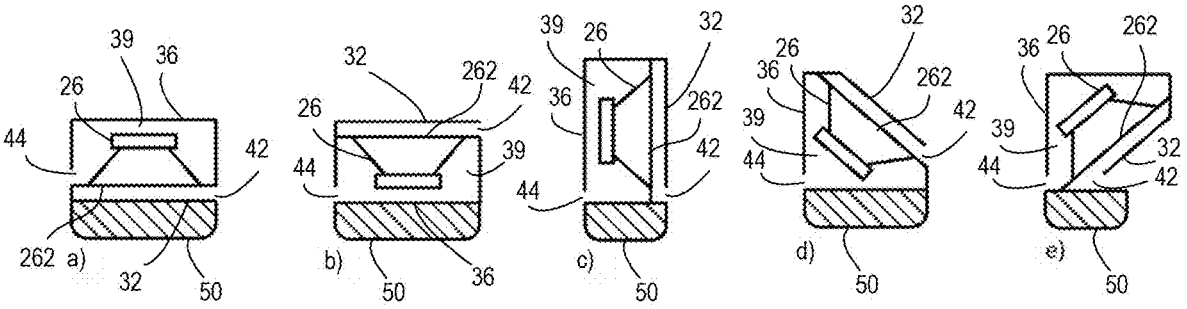
FIG. 18, including FIGS. 18 *a*) to *e*), schematically illustrates different sound sources arranged as dual waveguide dipoles.

If the loudspeaker arrangement is used over the full audio frequency range, dynamic loudspeakers may be arranged within dual waveguide dipole arrangements as illustrated in FIG. 18 such that a front side of the loudspeaker emits sound into the frontal waveguide chamber 34. The front side of a loudspeaker in this context is the side, which accommodates the membrane 262 (e.g., no motor assembly). Frontal waveguide in this context refers to a waveguide 32 of which the output 44 is oriented towards the user's ear. However, different loudspeaker arrangements exist that distribute the motor over both sides of the membrane 262. There is no general limitation for the proposed waveguides as to what side of the loudspeaker emits sound into the frontal waveguide chamber 34 and into the rear waveguide chamber 39. Nevertheless, the air volume in the frontal waveguide chamber 34 generally has a high influence on waveguide resonance and reflection behavior. Therefore, in some cases it may be desirable to control which objects are located within the frontal waveguide chamber 34 as opposed to having arbitrary loudspeaker motor components inside the frontal waveguide chamber 34. For a low frequency use of the arrangement, the motor side of the loudspeakers may also be prone to air noise or voice coil rubbing noise generation. It may, however, still be possible to supply sound to a frontal waveguide chamber 34 with the motor side of the loudspeaker. Different loudspeaker technologies exist and may arise in the future. The present waveguide arrangements are not restricted to any specific loudspeaker technology.

FIG. 18 schematically illustrates further examples of dual dipole waveguide arrangements. FIGS. 18 *a*) to *e*) schematically illustrate simplified cross-sections of the exemplary arrangements, and are merely used to describe the basic concept. It should be noted that further embodiments may have different shapes, sizes and/or loudspeaker orientations. The illustrated waveguide arrangements may be included in (larger) ear cup arrangements (see, e.g., FIG. 9 or FIG. 19) that comprise one or more waveguide arrangements. Ear cups 14 may also comprise additional loudspeakers without waveguides. FIGS. 18*a*) and b) illustrate loudspeakers 26, wherein the membranes 262 of the loudspeakers 26 are arranged approximately in parallel to the median plane (see FIG. 3) if the ear cup 14 is worn by a user 2. The loudspeaker membrane 262 in FIG. 18*a*) faces a frontal waveguide 32, wherein the frontal waveguide 32 comprises a lateral waveguide output 42. On the motor side (back side) of the loudspeaker 26, a rear waveguide 36 directs sound to the opposite side of the waveguide arrangement, thereby providing a maximum free air distance between the front waveguide output 42 and the rear waveguide output 44 without an increase in enclosure size (waveguide chamber size) as compared to a closed box arrangement without waveguides 32, 36. In the arrangement illustrated in FIG. 18*b*), the loudspeaker sides are reversed with respect to the median plane. This results in a frontal waveguide output 42 position that is further away from the cushion and thereby the contact area of the cushion to the user's head, when the sound source arrangement is integrated in a frame 15 of an ear cup 14 of a headphone arrangement that is worn by a user. This may be beneficial for loudspeaker positions behind the pinna. In the arrangement of FIG. 18*c*), the loudspeaker 26 is positioned such that its membrane 262 faces a direction approximately parallel to the median plane (membrane 262 approximately perpendicular to the median plane, see FIG. 3), when a user wears the ear cup 14. Again, the positions of the waveguide outputs 42, 44 are chosen such that the free air distance in between the two waveguide outputs 42, 44 is maximized. In the arrangements of FIGS. 18*d*) and e), the loudspeakers 26 are positioned at arbitrary angles with respect to the median plane. While the loudspeaker membrane 262 in the arrangement of FIG. 18*d*) is directed away from the median plane (see FIG. 3), the loudspeaker in the arrangement in Figure e) is directed towards the median plane. As described above, the free air distance between the front waveguide output 42 and the rear waveguide output 44 is maximized by means of outlet placement, without an increase of enclosure size as compared to a comparable closed box design.

In the examples in FIG. 18, the arrangement includes a cushion 50 (shaded area). The cushion 50 may be any cushion that is commonly used in headphone arrangements. The cushion 50 is generally arranged between the user's head and the loudspeaker arrangement within the frame 15 of the ear cup 14 when the headphone arrangement is worn by the user. That is, while the cushions 50 in FIG. 18 are illustrated in a horizontal position, this is typically not the orientation of the cushion 50 when worn by the user. The orientation of the cushion 50, when the headphone is worn by a user is, for example, illustrated in FIGS. 8 and 9.

Figure 19:
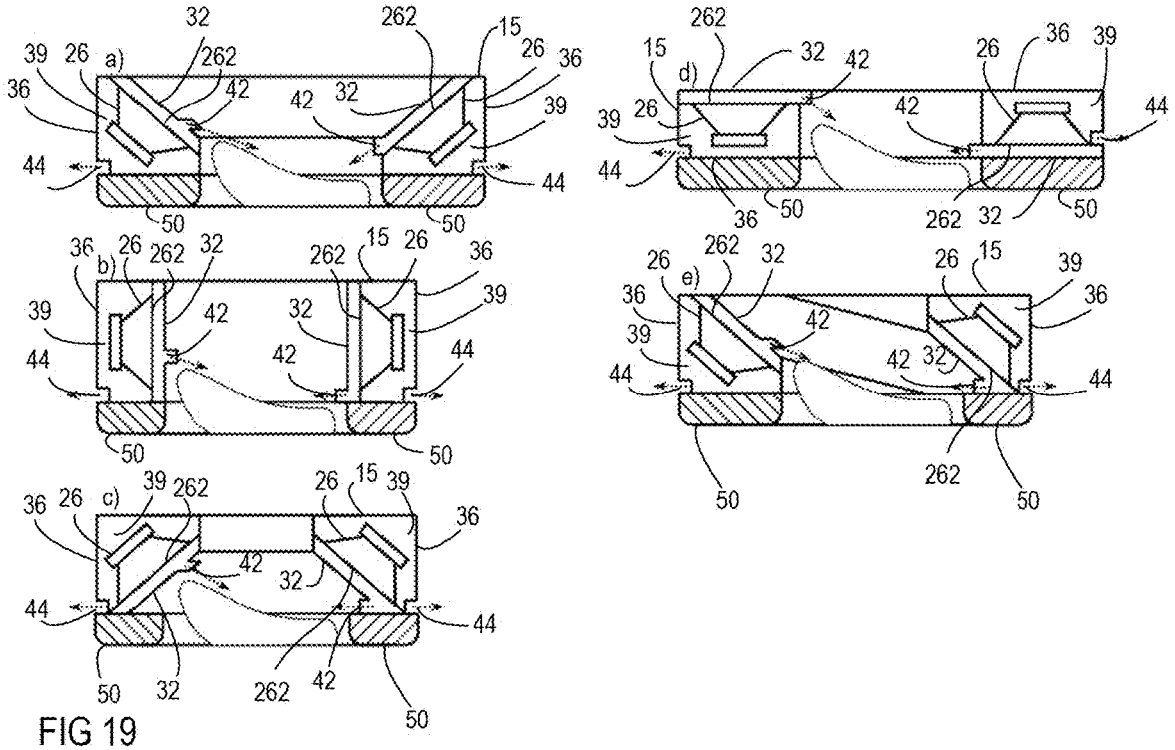
FIG. 19, including FIGS. 19 *a*) to *e*), schematically illustrates exemplary combinations of different sound source arrangements.

Waveguide arrangements as illustrated in FIG. 18 or in any of the other Figures, can be understood as building blocks that may be arranged in open or closed ear cups and may be combined with each other. The waveguide arrangements as described above may, for example, be integrated into open ear cups 14 (without cover 80) as is exemplarily illustrated in FIG. 19. The different arrangements of FIG. 19 illustrate simplified horizontal cross-to sectional views of a user's ear and a surrounding open ear cup 14. The arrangements in FIG. 19 each comprise at least two sound source arrangements with dual waveguides (comprising rear waveguide 36 and frontal waveguide 32). Any optional additional sound source arrangements or loudspeakers are not illustrated in FIG. 19. Generally, the shape of the ear cup illustrated in FIG. 19 may be largely similar to the shape of the ear cup 14 as illustrated in FIG. 8. However, the arrangements illustrated in FIG. 19 are rather meant to describe the basic principles of the present invention instead of representing specific implementation details, and do not restrict the shape of the ear cups 14 that may be used to incorporate the waveguide principles as described above. As has been described with respect to FIG. 18 before, the dual waveguide arrangements may be easily transformed to single waveguide arrangements (e.g. frontal waveguide or rear dipole waveguide). The arrows in FIG. 19 indicate waveguide outputs 42, 44 and possible sound paths especially between the frontal waveguide outputs 42 and the ear canal of the user.

FIG. 19*a*) illustrates a cross-sectional view of an ear cup 14. The ear cup comprises at least two loudspeakers 26 within a frame 15. The ear cup 14 is arranged around a user's ear when worn by a user. In this way, the ear cup 14 forms an open volume around the user's ear, the open volume is defined by the user's head and the ear cup 14. The outputs of frontal waveguides 42 are generally oriented towards this open volume around the ear of the user. Thereby frontal waveguide outputs 42 adjoin the open volume around the ear of the user. Sound that is emitted by the loudspeakers 26, may be directed towards the ear canal of the user by means of frontal waveguides 32. The chamber 34 that is formed by the frontal waveguide 32 has an output 42. Sound may exit the waveguide chamber 34 through this output 42 and is directed towards the ear canal of the user. The loudspeakers 26 are further arranged in rear waveguide chambers 39 formed by a rear waveguide 36. The rear waveguide chambers 39 also have outputs 44 which allow sound that is emitted by the back of the loudspeakers 26 to exit the rear waveguide chamber 39. The loudspeakers 26 in the arrangements of FIGS. 19*b*) to e) are arranged at different angles. In some of the examples, the membranes 262 of the loudspeakers 26 are arranged essentially parallel to each other. In some of the arrangements, the membranes 262 of the loudspeakers 26 are arranged essentially parallel to the median plane or the horizontal plane if the arrangement is arranged around a user's ear. In other examples, the membranes 262 of the loudspeakers 26 are arranged at an angle of between 0° and 180° with regard to the median plane.

The main purpose of FIG. 19 is to illustrate that a multitude of ear cup or frame shapes is possible, based on the previously described waveguide arrangements. The resulting ear cups or frames may have different characteristics, including depth, height and width of the ear cup 14 or frame 15, size of the ear cup opening towards free air (away from the user's head), as well as air volume inside the ear cup (around the ear). In addition, the free air distances between frontal waveguide outputs 42/rear waveguide outputs 44 and the ear canal entry of the user may differ. Further, the incidence angle at the user's ear of sound that is emitted by frontal waveguide outputs 42 may differ between different arrangements. Moreover, the described characteristics may have an influence on the spatial representation that is possible with the arrangement and the maximum SPL, especially at low frequencies.

Depending on product requirements, an appropriate ear cup construction may be chosen, which includes one or more of the dual waveguide dipole arrangements of FIG. 18 and, optionally, any number of additional loudspeakers. Most of the characteristics mentioned above can be directly evaluated by trend from the examples of FIG. 19, as loudspeaker sizes as well as the open space around the loudspeakers and the user's ear are mostly identical for different arrangements. Concerning the maximum low frequency SPL, the arrangement of FIG. 19*c*) is most promising, as the distance of all rear waveguide outputs 44 to the ear canal entry is comparably high and the internal volume around the ear is small. The former provides low dipole losses and the latter results in low SPL decrease over the distance between the frontal waveguide outputs 42 and the ear canal of the user. The maximum low frequency SPL of the arrangements of FIGS. 19*b*) and e) has a tendency to be lower than the maximum low frequency SPL of the arrangements of FIG. 19*c*). The arrangements of FIGS. 19*a*) and d) tend to provide less bass SPL than the arrangements of FIGS. 19*b*) and e).

As compared to the arrangements illustrated in FIG. 18, the waveguide output positions are partly different in the arrangements illustrated in FIG. 19. A basic feature of the proposed waveguide arrangements is the variable position of the waveguide outputs 42, 44. The positons of frontal waveguide outlets may, for example, shift from being arranged directly adjacent to the cushion 50 close to the user's head to being arranged at a side of the loudspeaker arrangement that is opposite to the cushion 50 (distant to the cushion 50). The to position of the frontal waveguide output 42 may depend on its location in the frame 15 around the user's ear, in order to follow typical lateral distance contours between head and pinna. In all examples of FIG. 19, frontal waveguide outputs 42 behind the pinna are deliberately positioned further away from the user's head or from the cushion 50, as to avoid a shading of direct sound towards the concha region by more exposed parts of the pinna. On the contrary, frontal waveguide outputs 42 in front of the pinna are positioned close to the head in order to be positioned close to the ear canal entry and to emulate frontal sound source incidence angles at the concha.

If a cover 80 is provided for the lateral opening of the ear cups 14 towards free air, all open ear cup arrangements of FIG. 19 may be converted to closed ear cups. Covers may either be permanently fixed to the frame 15 of the ear cup 14 or may be removable. External surfaces provided by frontal waveguides 32 support either a permanent or a removable installation of such covers 80 without any collisions between the cover and the loudspeaker membranes 262 or blocking of waveguide outputs 42, 44. It may be appreciated that an open ear cup without a lateral cover comprising one or more sound sources within its frame 15 arranged as dipoles, may develop sound radiation patterns containing multiple radiation lobes. At low frequencies, for example, a single sound source arranged as dipole with dual waveguide, may develop a radiation pattern with two main radiation lobes of inverted relative acoustical phase. The extent of these radiation lobes relative to the ear of the user may, for example, be controlled by the position of the frontal and rear waveguide outputs and the acoustical paths between those outputs. Two sound sources arranged as dipoles with dual waveguide that are arranged on essentially opposing sides of an ear, may develop a radiation pattern with three main radiation lobes, of which one exhibits an inverted relative acoustical phase as compared to the two other radiation lobes and is situated between these two other lobes. A multitude of sound sources arranged as dipoles with dual waveguide that are arranged around a user's ear, may develop two main radiation lobes of inverted phase. A first lobe that covers the ear and a second lobe that surrounds the first lobe and exhibits a ring-like shape. If a cover is attached to the ear cup that partly or completely closes the ear cup, the radiation lobes will also be affected. It is also worth noting, that the sound pressure level generated by a sound source arranged as dual waveguide dipole may decrease with increasing distance to the frontal waveguide output. Therefore, the sound pressure level received at the position of the ear canal entry may vary for varying placement of the waveguide output relative to the ear canal entry. The addition of further waveguide outputs at opposing sides of the ear can at least partly compensate for these variations. As the ear canal moves away from a first waveguide output it may move closer to a second, opposing waveguide output, which may compensate for SPL loss due to increased distance to the first waveguide output.

Figure 20:
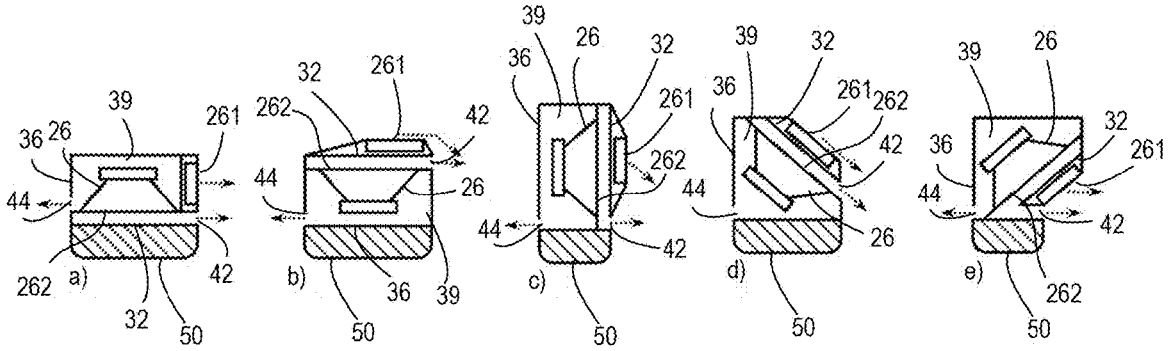
FIG. 20, including FIGS. 20 *a*) to *e*), schematically illustrates different sound sources arranged as dual waveguide dipole with additional directly radiating loudspeakers.

Loudspeaker arrangements comprising at least a frontal waveguide 32 or a rear waveguide 36 may also be combined with directly radiating loudspeakers without waveguides. Examples for such combinations of directly radiating loudspeakers with waveguide arrangements are illustrated in FIG. 20. Waveguides 32, 36 may be advantageous for low frequency SPL enhancement, for example. High frequency loudspeakers (e.g. above 2-4 kHz), however do not necessarily require an increase of SPL by means of waveguides. Such high frequency loudspeakers without waveguides may be comparably small. Therefore, these types of loudspeakers may be easily integrated into the waveguide arrangements as described above.

High frequency loudspeakers 261 are schematically illustrated as simple rectangles in in FIG. 20. One side of the high frequency loudspeakers 261 coincides with an external wall of the loudspeaker arrangement including the loudspeaker 26. The high frequency loudspeakers 261, therefore, resemble flush-mounted loudspeakers. A wall of the loudspeaker arrangement may be a sidewall of a rear chamber 30, or a sidewall of a frontal chamber 34, for example. For example, the high frequency loudspeaker 261 may be integrated in the rear waveguide 36 or in the frontal waveguide 32 or may form the rear waveguide 36 or the frontal waveguide 32. Such directly radiating loudspeakers 261 may avoid internal resonance and reflection effects of waveguide chambers 32, 30 and, therefore, are usually well suited for the generation of the frequency range that is important for the induction of natural pinna resonances (e.g. above 4 kHz). Both loudspeakers 26, 261 may be combined for acoustic signal playback similar to known two-way loudspeakers, which contribute partly overlapping frequency ranges with individual loudspeakers to support the complete frequency range of the system. Obviously, any further additional direct radiating loudspeakers may also be arranged on other parts of the ear cup 14, for example within parts of the ear cup 14 that face the user's ear.

As already noted above, multiple waveguide arrangements may be combined within a single ear cup 14. These waveguide arrangements may support the whole frequency range of the ear cup 14 or, as intended for the examples of FIG. 21, which will be described below, only part of the complete system's frequency range. High frequency loudspeakers 261 may also be mounted in small frontal waveguide chambers 321 with the waveguide opening 421 close to the frontal output 42 of larger waveguide arrangements, which support a lower frequency range.

Figure 21:
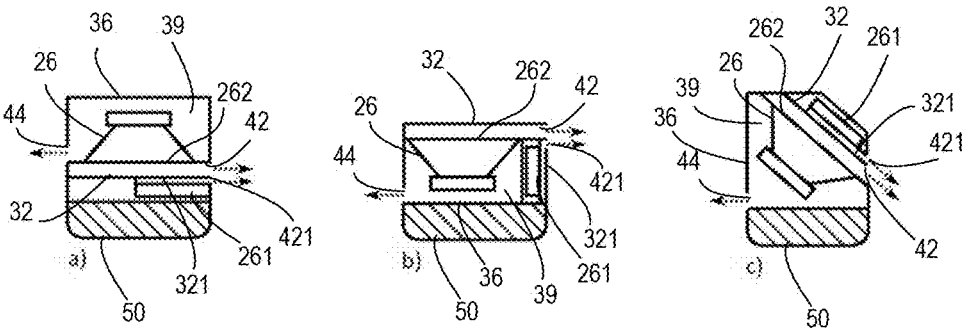
FIG. 21, including FIGS. 21 *a*) to *c*), schematically illustrates different sound sources arranged as dual waveguide dipole combined with sound source arrangements with frontal waveguides.

High frequency loudspeakers 261 are exemplarily illustrated as simple rectangles in FIG. 21, wherein one side of the high frequency loudspeakers 261 coincides with a wall of the illustrated waveguide arrangement. The examples illustrated in FIG. 21, each comprise a low frequency loudspeaker 26 and a high frequency loudspeaker 261. The high frequency loudspeaker 261 is smaller in size than the low frequency loudspeaker 26. The low frequency loudspeaker 26 has a first frontal waveguide 32 mounted in front of the loudspeaker membrane 262, as has been described above. The low frequency loudspeaker 26 may further have a rear waveguide 36 mounted at the back of the loudspeaker 26, as has been described above. The high frequency loudspeaker 261 may have a second frontal waveguide 321 mounted in front of its membrane 262. The basic structure of the high frequency loudspeaker 261 and the second frontal waveguide 321 is the same as for the low frequency loudspeaker 26 and the first frontal waveguide 32. The first output 42 of the first frontal waveguide chamber may be arranged adjacent to the second output 421 of the second frontal waveguide chamber formed by the second frontal waveguide 32. Both outputs 42, 421, therefore, may direct sound essentially in the same direction. Providing proximate outlets 42, 421 may improve the consistency with regard to sound source location, radiation characteristics and reflections off other parts of the ear cup 14, thereby supporting the perception of the combined sound source by the user as a single source. An advantage of separate frontal waveguides for low and high frequency ranges is the potentially smaller size for the high frequency waveguide 321. As loudspeakers 261 that merely support the frequency range above e.g. 2 kHz can be quite small, frontal waveguides 321 can also be considerably smaller for those small loudspeakers than for larger low frequency loudspeakers 26, thereby shifting the internal resonance and reflection effect upwards in frequency and potentially out of the sensitive range for localization cues (e.g. above 15 kHz).

Figure 22:
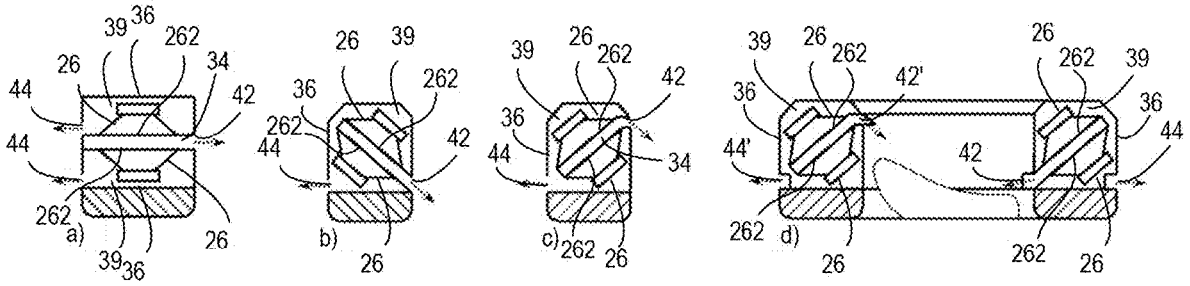
FIG. 22, including FIGS. 22 *a*) to *d*), schematically illustrates different sound source arrangements with dual waveguide dipoles and impulse compensation.

Examples for the combination of multiple loudspeakers within a single waveguide 32 are illustrated in FIG. 22. In the different arrangements of FIG. 22, two loudspeakers 26 share a single frontal waveguide 32 with waveguide chamber 34. The rear dipole waveguide 36 of each loudspeaker 26 may either be individual for each loudspeaker 26 (see FIG. 22*a*)) with individual rear waveguide chambers 39 or may be combined for both loudspeakers 26 (see FIG. 22*b*) to d)) with a single rear waveguide chamber. The membranes 262 of the two loudspeakers 26 may face each other and may be arranged at a distance of less than 1 cm, less than 0.5 cm or even less than 0.3 cm from each other. This is, a width d1 (see FIG. 6*e*)) of the frontal waveguide may be less than lcm, less than 0.5 cm or even less than 0.3 cm. The backs of the loudspeakers 26 may be arranged within the same rear waveguide chamber 39 which has a single output 44. Therefore, sound emitted by the backs of the loudspeakers 26 exits the rear waveguide chamber 39 through the same output 44. One advantage of such an arrangement is the cancellation of impulses (directed force), that loudspeakers may generally couple into the frame 15 of the ear cups 14. Two equal loudspeakers 26 that are mounted front to front and that are playing in phase with each other may create impulses of equal force and of opposing direction, which may cancel mutually if the loudspeakers are connected mechanically by a stiff structure.

In addition, the combination of multiple, optionally smaller loudspeakers, may allow different form factors as compared to arrangements including a single (not more than one) larger loudspeaker. Within a complete ear cup 14, multiple waveguide arrangements, as have been illustrated by means of FIG. 22 (as well as by FIGS. 18, 20 and 21), may be arranged side by side, possibly around the complete ear (along the complete perimeter of the frame 15). These individual waveguide arrangements may be mechanically separated from each other by means of some kind of mechanical dividers, such that only two loudspeakers (or one loudspeaker respectively) play into a single frontal waveguide chamber 34. Multiple waveguide assemblies may also be combined into a large frontal or rear dipole waveguide 32, 36, comprising more than two loudspeakers per waveguide 32, 36. An exemplary ear cup 14 comprising two loudspeakers arranged each in front and back of the pinna is exemplarily illustrated in FIG. 22*d*).

As has been described above, one or more waveguide arrangements and, possibly, additional direct radiating loudspeakers may be combined in a single ear cup 14. Waveguide arrangements may cover the whole frequency range that is to be supported by the ear cup 14 to or just parts of this frequency range. Generally, the SPL at the ear canal entry of the user will be higher for a given waveguide arrangement in front of the pinna than for a waveguide arrangement behind the pinna. Therefore, outputs of frontal waveguides 32 that merely support the lowest frequency range of the complete ear cup, may be placed in front of the pinna, for example.

Another important aspect is the directional pinna cue induced by the respective loudspeaker or waveguide arrangement that depends on the location of the frontal waveguide output 44 with respect to the concha. For individual sound sources (e.g., loudspeakers) that are arranged in front or behind as well as above or below the pinna, the directional pinna cue that may be induced through natural pinna resonances, may be associated with corresponding directions within the median plane. Therefore, if the induction of directional cues associated with specific directions is desired, the waveguide output 44 may be placed at the corresponding location around the pinna. Generally, directions within the median plane are most challenging to meet with binaurally synthesized virtual sources on headphones. Thus, available directional cues are most beneficial if associated with directions close to the median plane. In this regard, placement of frontal waveguide outputs 42 or direct radiating loudspeakers should preferably be close to a plane through the entry of the ear canal, the plane being parallel to the median plane. As the rear side of the pinna may block sound from sources directly behind it, sound outputs 42 at the back of the pinna may be placed further outside of this plane to avoid major amplitude response alterations by shading effects.

In order to be able to control the perceived sound source direction by controlling the signal distribution across multiple loudspeakers, waveguide outputs 42 and/or direct radiating loudspeakers may be arranged at multiple locations around the pinna. The loudspeakers may be configured to output sound at frequencies of between at least 4 kHz and 16 kHz. For example, one or more sound sources may be arranged in front and behind the pinna, close to a horizontal plane that runs through the entry of the ear canal of the user (e.g., horizontal plane as illustrated in FIG. 3, or another plane that is parallel to the horizontal plane of FIG. 3). Such sound sources may be configured to synthesize virtual sources all around the head within the horizontal plane or even in 3D space all around the user's head. Generally the positioning accuracy of sound sources within an ear cup 14 relative to individual human ears is quite low. Therefore, it may be beneficial to have multiple waveguide outputs 42 or generally sound sources in front of and behind the pinna, which may provide a more stable directional cue if simply playing in parallel. The sound sources may further allow for an adjustment of perceived sound image elevation by distributing the sound signal over adjacent loudspeakers. Given the usually narrow space that is available for loudspeakers within preferably small ear cups and the challenges to produce low frequencies with adequate SPL, a loudspeaker distribution similar to FIG. 9, with multiple loudspeakers each in front of (20, 22, 24) and behind (20', 22', 24') the pinna and close-by frontal waveguide outputs 42 is a viable option. Additional high frequency sound sources, either direct radiating or waveguide loaded above the pinna may allow for an improved spaciousness and realism for virtual sources from above. Sound sources all around the head may, however, also be synthesized without additional sound sources above the ears.

Generally, sound sources from largely opposing directions (e.g., front and back, top and bottom, etc.) may be beneficial in many cases. If one of the available directions is in front of the pinna (the user perceives the sound as coming from the front), this may help to reduce front-back confusion. For normal stereo playback as well as standard HRTF based binaural synthesis as, for example, provided by known virtual reality headsets, no directional bias may be desired. For this case, parallel playback by multiple superimposed sound sources from largely opposing directions can approximate a directionally neutral (highly diffuse) sound field at the pinna. For spatially enhanced stereo playback, multiple virtual sources around the head are already beneficial. For this case and any more enhanced setups of audio channels and or audio objects, the signal may be distributed over sources from opposing directions to enable virtual source synthesis. With only a strong directional cue from a single direction, synthesis of other directions is usually of low realism, if it is possible at all.

Embodiments of the proposed headphone arrangements may include multiple loudspeakers that may be individually controlled by individual electrical signals. Furthermore, the voice coil impedance and/or efficiency of the loudspeakers may not be compatible with standard headphone amplifiers like, for example, headphone amplifiers as provided in many smart phones today. Therefore, the headphone arrangement may include at least one electronic driving unit that is configured to receive an input signal and to apply the conditioned input signal as a driving signal to a single or multiple loudspeakers. Furthermore, processing of the electrical sound signals may be required in some applications in order to achieve certain sound quality or spatial sound characteristics. Therefore, the headphone arrangement may include at least one signal processing unit that is configured to receive at least one input signal, to process the at least one input signal and to emit at least one processed input signal to at least one electronic driving unit.

Closed ear cups generally differ from open ear cups in several aspects. E.g., visual appearance, air ventilation, environmental sound suppression, audibility of internal sound outside the device, size and position of the perceived sound image and maximum low frequency SPL are some of the important distinguishing features.

As has already been discussed above, ear cups in which the present invention may be used may be either open (comprising a frame 15) or closed (comprising a frame 15 and a cover 80), independent from the type of waveguide implementation (e.g. frontal waveguide, rear dipole waveguide or dual waveguide dipole) that is used for the loudspeakers 26. If the cushion 50 between the frame 15 and the head of the user encircles the complete ear of the user, a cover or cap 80 may either be mounted permanently to the frame 15 or may be provided as a removable part that may be attached to or removed from the frame 15. The cover 80 may be configured to provide reasonable sealing against air leakage, if desired. It should, however, be noted that cushions 50 as well as frames 15 and open ear cups 14 in general may encircle the ear only partially. For example, the frame 15 may comprise recesses, breaks or gaps in its circumference. Covers 80, however, may also be combined with frames 15 that do not have a continuous circumference for various reasons. Such reasons will be given in the following. Most aspects concerning covers 80 apply similarly for frames that only partly enframe the ear (that include recesses, breaks or gaps in their circumference) as for frames 15 that fully enframe the ear. FIG. 23 schematically illustrates an example of a cover 80 for the ear cup 14. The ear cup 14 comprises three loudspeakers 20, 22, 24 arranged as three dual waveguide dipoles in front of the pinna and three loudspeakers 20', 22', 24' arranged as three dual waveguide dipoles behind the pinna. The Figure illustrates the frame 15 with the cover 80 mounted thereon (FIG. 23*a*) and with the cover 80 removed from the frame 15 (FIG. 23*b*). The cover 80 may either be permanently coupled to the frame 15 or may be detachable. An advantage of ear cups 14 with permanently closed back (cover 80 permanently coupled to the frame 15), wherein the ear cup 14 comprises at least one waveguide arrangement according to the present invention, as compared to known closed back ear cups, is the directional incidence of sound at the pinna, which allows the induction of natural directional pinna cues. Detachable covers 80, however, generally provide far more versatility, as the user may choose open or closed ear cups 14 based on the situation and the environments.

Covers or caps 80 may comprise a soft or solid material. The material of the cover 80 may optionally be perforated in any way to create semi-open ear cups which may, for example, block the sight on the ear of the user completely or partially but may still allow air to exchange through the cover 80. Covers or caps 80 may also only partly close the lateral opening of the frame 15. The cover 80, therefore, may comprise openings of any size and/or shape. For example, large openings in the region of the upper and/or lower end of the frame 15 may provide air ventilation based on stack-effects while providing some low frequency boost. Such covers 80 including openings may visually appear the same or similar to covers 80 without any openings. These kinds of open covers 80 may be combined with sound absorbing surfaces inside the ear cup 14, for example on wall portions of the frame 15 or on the inside of the cover 80. In this way, the cover 80 may further provide a certain reduction of environmental noise, comparable to known open-back headphones. Furthermore, covers 80 may be configured to only block light instead of sound (e.g. acoustically transparent fabrics), thereby merely preventing the visual exposure of the ear but still allowing the perception of the acoustic environment. Due to the influence of covers on the acoustics of the ear cup, they may be utilized to tune sound characteristics to taste (e.g. frequency response, sound image externalization). For example, sound image externalization will decrease with the amount of reflected sound energy from a cover towards the pinna. So different configurations of the cover concerning size, shape and sound absorption coefficient of the internal cover surface, may be used to control externalization to some extent. Finally, exchangeable covers 80 may be part of a customizable visual design, with any combination of different colors, patterns, surfaces and materials on a multitude of optionally available covers. Covers 80 may, for example, be sold as an aftermarket product.

Depending on the characteristics of the cover 80, the acoustics of the ear cup 14 may change considerably when a detachable cover 80 is mounted on the frame 15. Especially the amplitude response may be boosted at low to medium frequencies for a fully closed cover 80. Semi-open covers 80 may generate any intermediate amplitude boost. As this amplitude response change may not be desired, it can be compensated actively by the headphone. For this purpose, one or more sensors and/or switches may be integrated to the frame 15 and/or the cover 80 to detect the presence of a cover 80 and potentially differentiate between different cover types (e.g., cover with openings, cover without openings, etc.). An electronic control unit may be included in the headphone that evaluates the sensor outputs or switch states and controls the amplitude response of the ear cup 14 accordingly. This may, for example, be realized by means of suitable digital or analog filters, which affect the audio signal that is fed to the loudspeakers.

One objective of the headphone arrangements according to the present invention is the controlled induction of natural pinna resonances in order to add personal directional cues to the audio signal, if desired. For this purpose, sound may reach the pinna and most importantly the concha of the ear from a preferably distinctive direction without any strong reflections from nearby surfaces. Reflections may, however, also be detrimental to the general tonality of the ear cup 14, which is important independently from the generation of pinna resonances. Reflections cause peaks and dips in the amplitude response of the ear cup 14, that change over the position within the ear cup 14. Therefore, they usually cannot be equalized over a larger area within the ear cup 14 by mere application of filters. As a result, the amplitude response may vary for different wearing positions and for different users. This is, for example, detrimental for a precise binaural synthesis of directional audio, for instance, with individual head related transfer functions and headphone calibration, as the latter is ineffective if the amplitude response changes every time the user puts the headphone on. The problems concerning reflections as described above, however, merely concern the frequency region of above 1-4 kHz. Below this frequency range, neither pinna resonances nor local cancellation effects occur within typical ear cup dimensions due to higher wavelengths of lower frequencies.

Reflections, therefore, may be reduced by taking suitable measures to avoid the detrimental effects that have been described above. This is, for example, possible by systematic orientation of reflective surfaces relative to the pinna or concha. Reflective surfaces may also be covered with sound absorbing material. FIG. 23 schematically illustrates examples of both measures. In the example of FIG. 23, the external surfaces of the frontal waveguides 20, 22, 24 are tilted such that they face away from the pinna, which avoids reflections towards the pinna from large parts of the total surface area around the ear. These surfaces may additionally be covered with sound absorbing material (shaded areas in FIG. 23). In this regard, headphone arrangements comprising frontal waveguides 20, 22, 24 may provide benefits, namely almost the entire surface of the ear cup 14, which surrounds the user's ear, may be covered with sound absorbing material, as there are no open loudspeaker membranes 262. Exposed loudspeaker membranes 262 are reflective themselves but cannot be covered with damping material. Surfaces that are oriented towards the pinna and, therefore, may reflect sound towards the pinna, may be covered with sound absorbing material (hatched areas in the cross section views of FIG. 23). For example, open-cell foam may be used for the cushions 50, which may be wrapped by acoustically transparent fabric on the inside (ear facing side) of the cushion 50. If such a material is attached as illustrated in FIG. 23, reflections from the enclosure edges towards the pinna may be reduced drastically with relatively thin layers of foam. Care, however, may be taken that sound is attenuated somewhere in the cushions 50. Otherwise, the sound from any rear waveguide outlets may travel the relatively short way through the cushion 50 towards the ear canal entry and cause excessive dipole losses. For example, the external side (outside the volume enclosed at least partly by the ear cup 14) and the side of the cushion 50 that contacts the users head, may be wrapped in material with low air permeability (e.g. faux leather) to block the short path towards the ear canal entry. Alternatively or additionally, at least part of the cushion may comprise a soft, elastic or flexible material of relatively high volume weight (e.g. open or closed cell foam, gel). A wrapping material with low air permeability may optionally be bonded to this soft, elastic or flexible material. For example, gel cushions and closed cell foam cushions are known to provide good acoustic sealing in earmuffs. Such a material may be applied to either the complete cushion or only to a part of the cushion that is positioned closely to the rear waveguide outlets (around the perimeter of the frame 15). A part of the cushion that is oriented towards the inside of the ear cup may still comprise a material with high sound absorption coefficient (e.g. open cell foam) in order to reduce internal reflections. A part of the cushion that is oriented towards the inside of the ear cup may also be wrapped in acoustically transparent material. Also illustrated in FIG. 23 is a sound absorbing material that is attached to the optionally removable cover. This may further reduce detrimental effects of internal reflections and may provide a partly externalized sound image even without additional signal processing.

Feedback microphones may be positioned inside one or more of the front or back waveguide chambers 30, 34 to provide distortion compensation of one or more loudspeakers by providing one or more feedback loops. If multiple identical loudspeakers 26 are employed and driven by identical signals, at least over a certain frequency range (e.g. low frequency range), these loudspeakers 26 may be compensated in combination. Loudspeakers may share a single feedback loop or may at least be driven by the compensated signal out of a separate feedback loop. If the loudspeakers 26 share a single waveguide 32, 36, one or more microphones may be used to sense the combined loudspeaker output. If multiple microphones are used, their output signals may be combined with each other to feed a single feedback loop. If the loudspeakers 26 are mounted within separate waveguide chambers 30, 34, microphones may be placed within one or more waveguide chambers 30, 34, wherein the output signals of the microphones may be combined with each other and be fed into a single feedback loop. The compensated loudspeaker driving signal may also be applied to other similar loudspeakers within similar waveguide arrangements that do not have a microphone inside the waveguide chamber 39, 34 and, therefore, do not contribute to the feedback loop.

It is further possible to provide active noise cancellation (ANC). For active noise cancellation, one or multiple feedback microphones may be positioned close to the ANC target position (e.g. entry of ear canal) or, alternatively, close to one or more frontal waveguide outlets 42. If multiple microphones are provided to provide ANC, their outputs may be combined with each other and may be fed into a single feedback loop, wherein the single feedback loop comprises all loudspeakers that drive the waveguides and at whose outputs microphones are positioned.

If a permanent or removable rear cover 80 is applied to the headphone construction as described above, a microphone may be attached to this cover 80 at a position that brings it close to the entry of the ear canal. A bar may be attached to the cover with a microphone at the other end, which brings the microphone as close to the entry of the ear canal as possible without risking a collision of the microphone and the ear. As mentioned above, this microphone may also be used in a feedback loop with one or multiple loudspeakers to facilitate active noise and distortion cancellation. Microphones on removable covers 80 may require an electronic connection to the ear cups 14 for signal transmission. ANC feedback loops are generally known and will, therefore, not be discussed in further detail herein.

If a removable or permanent back cover 80 is applied to the headphone construction, microphones may be placed on the outside of the ear cup 14 for active noise cancellation based on feed forward techniques and for support of awareness modes for acoustical events in the environment. The former allows improving noise cancellation performance especially for frequency ranges that cannot be included inside feedback loops due to stability issues. The latter, for example, may be useful if the user walks through city traffic and needs to be aware of traffic noises or if the user wants to talk to someone. Microphones on removable covers 80 may require electronic connection to the frame 15 for signal transmission. Feed forward active noise cancellation techniques are commonly known and, therefore, will not be described in further detail herein.

Figure 25:
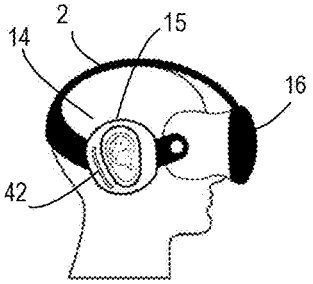
FIG. 25 schematically illustrates an augmented reality AR headset with integrated sound sources.

FIG. 24 schematically illustrates examples of ear cups comprising waveguide arrangements as described herein. Two ear cups 14 may be connected with each other by a typical headband 12 for fixation of the headphone arrangement on a user's head. The headband 12 may connect to the frame 15 or to a permanently attached cover 80 if the ear cups 14 comprise such a permanently fixed cover 80. Any other fixation method on the head, neck or torso is also possible. Furthermore, ear cups 14 or frames 15 including one or more waveguide arrangements may be integrated into virtual or augmented reality headsets as is exemplarily illustrated in FIG. 25. A virtual or augmented reality headset may comprise an ear cup 14 or a frame 15 for each ear and a display 16 that may be arranged in front of the user's eyes. The display 16 and the ear cups 14 or frames 15 may be held on the user's head by an appropriate headband construction. The ear cups 14 in the examples of FIGS. 24 and 25 are illustrated as open ear cups 14 without a cover. Therefore, frontal waveguide outputs 42 may be visible, which is the case for the frontal waveguide outputs 42 behind the pinna for the example of FIG. 24.

In the following, several examples of headphone arrangements will be described.

Example 1: According to a first example, a headphone arrangement comprises an ear cup 14 configured to be arranged to at least partly surround an ear of a user 2, thereby defining an at least partly enclosed volume about the ear of the user 2, wherein the ear cup 14 comprises an at least partially hollow frame 15 configured to at least partially enframe the ear of the user when the ear cup 14 is arranged to surround the ear of the user, and wherein the frame 15 comprises a first cavity 34, 39, the first cavity being formed by wall portions of the frame 15. The arrangement further comprises at least one loudspeaker 26 arranged within wall portions of the first cavity 34, 39, wherein wall portions of the first cavity 34, 39 form a first waveguide 32, 36 configured to guide sound radiated from the loudspeaker 26 through a waveguide output 42, 44 of the first waveguide 32, 36, and wherein the waveguide output 42, 44 of the first waveguide 32, 36 comprises one or more openings in the first cavity 34, 39.

Example 2: The headphone arrangement of example 1, wherein, when the ear cup 14 is arranged to surround the ear of the user 2, a virtual perpendicular projection of the frame 15 onto a median plane at least partly enframes at least a central part of a virtual perpendicular projection of the user's outer ear onto the median plane, wherein the median plane crosses the user's head midway between the ears, thereby dividing the users head into essentially mirror-symmetrical left and right half sides.

Example 3: The headphone arrangement of example 2, wherein a central part of the virtual perpendicular projection of the user's outer ear onto the median plane, which is at least partly enframed by the virtual perpendicular projection of the frame 15 onto the median plane, comprises the virtual perpendicular projection onto the median plane of at least one of: part of the cocha of the user's ear, the complete concha of the user's ear, part of the cymba of the user's ear, the complete cymba of the user's ear, and at least 30%, at least 45% or at least 60% of the complete pinna.

Example 4: The headphone arrangement of any of the preceding examples, wherein wall portions of the first cavity 39 and the at least one loudspeaker 26 form a first sound source arrangement, the at least one loudspeaker 26 comprises a membrane 262 with a first side and a second side, the first side of the membrane 262 adjoins the at least partly enclosed volume about the ear of the user 2, wall portions of the first cavity 39 surround the second side of the membrane 262 of the at least one loudspeaker 26, and the waveguide output 44 of the first cavity 39 opens towards free air outside the ear cup 14, wall portions of the first cavity 39 thereby forming a rear waveguide 36.

Example 5: The headphone arrangement of any of examples 1 to 3, further comprising a second cavity 34 within the frame 15, wherein wall portions of the first cavity 39, wall portions of the second cavity 34 and the at least one loudspeaker 26 form a first sound source arrangement, the at least one loudspeaker 26 comprises a membrane 262 with a first side and a second side, the at least one loudspeaker 26 is arranged within common wall portions of the first cavity 39 and the second cavity 34, wall portions of the second cavity 34 surround the first side of the membrane 262 of the at least one loudspeaker 26, a volume adjoining the second side of the membrane 262 of the at least one loudspeaker 26 is completely enclosed by wall portions of the first cavity 39 and by parts of the at least one loudspeaker 26, and the waveguide output 42 of the second cavity 34 opens towards the at least partly enclosed volume about the ear of the user 2, wall portions of the second cavity 34 thereby forming a frontal waveguide 32.

Example 6: The headphone arrangement of any of examples 1 to 3, further comprising a second cavity 34 within the frame 15, wherein wall portions of the first cavity 39, wall portions of the second cavity 34 and the at least one loudspeaker 26 form a first sound source arrangement, the at least one loudspeaker 26 comprises a membrane 262 with a first side and a second side, the at least one loudspeaker 26 is arranged within common wall portions of the first cavity 39 and the second cavity 34, wall portions of the second cavity 34 surround the first side of the membrane 262 of the at least one loudspeaker 26, wall portions of the second cavity 34 are configured to guide sound that is radiated from the first side of the membrane 262 of the at least one loudspeaker 26 through at least one output 42 of the second cavity 34 to the outside of the frame 15, wall portions of the second cavity 34 form a second waveguide 32 and the at least one output 42 in the second cavity 34 forms a waveguide output 42 of the second waveguide 32, and when the ear cup 14 is arranged to surround the ear of the user 2, the waveguide output 42 of the second waveguide 32 opens towards the at least partly enclosed volume about the ear of the user 2, and the waveguide output 44 of the first waveguide 36 opens towards free air outside the ear cup 14, wall portions of the first cavity 39 thereby forming a rear waveguide 36, and wall portions of the second cavity 34 thereby forming a frontal waveguide 32.

Example 7: The headphone arrangement of any of the preceding examples, wherein a to solid angle $\Omega$ subtended at the geometric or acoustic center of the membrane 262 of one loudspeaker 26, surrounded by wall portions of at least the first waveguide 32, 36 by the total area within the smallest outline enclosing the waveguide output 42, 44 of the first waveguide 32, 36 is less than $\pi$ steradian or less than $\pi/2$ steradian.

Example 8: The headphone arrangement of any of the preceding examples, wherein the air volume within at least one waveguide is less than 2 times, less than 5 times or less than 10 times the maximum volume displacement of all loudspeaker membranes 262 that are surrounded by wall portions of the waveguide.

Example 9: The headphone arrangement of any of the preceding examples, wherein the area of the waveguide output of at least one waveguide is at least 30%, at least 50% or at least 70% smaller than the area of all loudspeaker membranes 262 that are surrounded by wall portions of the waveguide.

Example 10: The headphone arrangement of any of examples 5 to 9, wherein, when the ear cup 14 is arranged to surround the ear of the user 2, an average distance from the waveguide output 42 of at least one frontal waveguide 32 to the ear canal entry of the user is at least 30%, at least 40% or at least 60% shorter than an average distance from the membrane 262 of at least one loudspeaker 26, arranged within the frontal waveguide 32, to the ear canal entry of the user 2.

Example 11: The headphone arrangement of any of examples 5 to 10, wherein at least one output of at least one frontal waveguide is arranged such that, when the ear cup 14 is arranged to surround the ear of the user 2, the average direction of sound arrival from the frontal waveguide at the concha area of the user's ear differs from the average direction from the geometric or acoustic center of the loudspeaker membrane 262 of a loudspeaker 26 within the frontal waveguide towards the concha area of the user's ear.

Example 12: The headphone arrangement of any of examples 4 to 11, further comprising at least one additional sound source arrangement within the frame 15, the additional sound source arrangement being configured such that sound radiated by the additional sound source arrangement is directed towards the concha of the user's ear when the ear cup 14 is arranged to surround the ear of the user 2.

Example 13: The headphone arrangement of any of examples 4 to 12, further comprising at least one additional sound source arrangement within the frame 15, wherein, when the ear cup 14 is arranged to surround the ear of the user 2, sound radiated by at least one sound source arrangement is directed towards the concha of the user's ear from a frontal direction in front of a frontal plane, and sound radiated by at least one sound source arrangement is directed towards the concha of the user's ear from a rear direction behind the frontal plane, wherein the frontal plane is perpendicular to the median plane and runs through both ears of the user, thereby dividing the user's head into a frontal part and a rear part.

Example 14: The headphone arrangement of any of examples 5 to 13, comprising at least two frontal waveguides 32 arranged within the frame 15, wherein at least one waveguide output 42 is configured to radiate sound towards the concha of the user's ear from a frontal direction, in front of the frontal plane, and at least one waveguide output 42 is configured to radiate sound towards the concha of the user's ear from a rear direction, behind the frontal plane.

Example 15: The headphone arrangement of any of examples 5 to 14, wherein the waveguide output 42 of at least one frontal waveguide 32 further comprises at least one protrusion which protrudes in a direction towards the ear of the user 2 when the ear cup 14 is arranged to surround the ear of the user 2, the protrusion thereby reducing the volume into which sound from the waveguide output 42 expands until it reaches the ear canal entry of the user 2.

Example 16: The headphone arrangement of any of the preceding examples, comprising at least two waveguides 32, 36 arranged within the frame 15, wherein the waveguide outputs 42, 44 of the two waveguides are arranged adjacent to each other to form an essentially continuous combined waveguide output along parts of the frame 15.

Example 17: The headphone arrangement of example 16, wherein at least one continuous combined waveguide output is arranged on parts of the frame 15 such that it runs approximately parallel to at least a part of the lateral contour of the perimeter of the user's pinna, when the ear cup 14 is arranged to surround the ear of the user 2.

Example 18: The headphone arrangement of any of the preceding examples, wherein to the frame 15 further comprises a retaining fixture that enables the attachment and removal of a removable cover 80 in order to laterally cover the ear at least partly, when the ear cup 14 is arranged to surround the ear of the user 2.

Example 19: The headphone arrangement of example 18, further comprising a detection unit configured to detect at least one of: whether a removable cover 80 is attached to the frame 15, and which of at least two different types of the removable cover 80 is attached to the frame 15.

Example 20: The headphone arrangement of any of the preceding examples, wherein the ear cup 14 further comprises a cover 80 that is attached to the frame 15 and laterally covers the ear at least partly when the ear cup 14 is arranged to surround the ear of the user 2, thereby forming a partly open or completely closed ear cup 14.

Example 21: The headphone arrangement of any of the preceding examples, further comprising a cushion 50 which is arranged between the frame 15 and the user's head when the ear cup 14 is arranged to surround the ear of the user 2, the cushion 50 being configured to attenuate low frequency sound that propagates between the frame 14 and the head of the user 2, the cushion 50 comprising at least one of: closed cell foam, closed cell foam and open cell foam, open cell foam which is at least partly covered by a material with low air permeability, open cell foam which is at least partly bonded to a material with low air permeability, a soft material with a volume weight of more than 50 kg/m3, and a gel comprising a fluid.

Example 22: The headphone arrangement of any of the preceding examples, further comprising a cushion 50 which is arranged between the frame 15 and the user's head when the ear cup 14 is arranged to surround the ear of the user 2, wherein the cushion 50 is configured to reduce acoustic reflections directed towards the ear of the user 50, and wherein the cushion comprises at least one of: a sound absorbing material, a sound absorbing material which is at least partly covered by a material with high air permeability, open cell foam which is at least partly covered by a material with high air permeability, a sound absorbing fabric, and sound absorbing fibers.

Example 23: The headphone arrangement of any of the preceding examples, wherein to an approximated sound pressure loss IL, caused by at least one waveguide output with a cross section area smaller than the membrane area of the at least one loudspeaker 26 within the first waveguide, is less than 0.5 dB or less than 0.75 dB, wherein the sound pressure loss IL is approximated as $IL=0.01*(Vd/Aw)^2+0.001*(Vd/Aw)$, wherein Vd is the maximum volume displacement of the membrane 262 of the at least one loudspeaker (26), and Aw is the cross section area of the waveguide output.

Example 24: The headphone arrangement of any of the preceding examples, further comprising at least one microphone arranged within at least one waveguide.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

The invention claimed is:

1. A headphone arrangement comprising:

an ear cup configured to be arranged to at least partly surround an ear of a user to define an at least partly enclosed volume about the ear of the user, wherein the ear cup comprises an at least partly hollow frame configured to at least partly enframe the at least partly enclosed volume about the ear of the user when the ear cup is arranged to surround the ear of the user, the frame to at least partly enframing at least a part of the ear of the user as viewed from a lateral direction when the ear cup is arranged to at least partly surround the ear of the user, and wherein the frame comprises a first cavity, the first cavity being formed by wall portions of the frame;

at least one loudspeaker comprising a membrane with a first side and a second side, the at least one loudspeaker is arranged within wall portions of the first cavity, wherein wall portions of the first cavity form a first waveguide configured to guide sound radiated from the first side or from the second side of the loudspeaker membrane through a waveguide output of the first waveguide, the waveguide output of the first waveguide comprises one or more openings in the first cavity, and either sound radiated from the first side of the loudspeaker membrane, or sound radiated from the second side of the loudspeaker membrane is directed towards the at least partly enclosed volume about the ear of the user;

a second cavity within the frame, wherein the wall portions of the first cavity, wall portions of the second cavity and the at least one loudspeaker form a first sound source arrangement;

the at least one loudspeaker is arranged within common wall portions of the first cavity and the second cavity; and the wall portions of the second cavity surround the first side of the membrane of the at least one loudspeaker; and a volume adjoining the second side of the membrane of the at least one loudspeaker is completely enclosed by wall portions of the first cavity and by parts of the at least one loudspeaker; and the waveguide output of the second cavity opens towards the at least partly enclosed volume about the ear of the user, the wall portions of the second cavity to form a frontal waveguide.

2. The headphone arrangement of claim 1, wherein, when the ear cup is arranged to surround the ear of the user, a virtual perpendicular projection of the frame onto a median plane at least partly enframes at least a central part of a virtual perpendicular projection of the user's outer ear onto the median plane, wherein the median plane crosses a user's head midway between the ears, thereby dividing the user's head into essentially mirror-symmetrical left and right half sides.

3. The headphone arrangement of claim 2, wherein a central part of the virtual perpendicular projection of the user's outer ear onto the median plane, which is at least partly enframed by the virtual perpendicular projection of the frame onto the median plane, comprises the virtual perpendicular projection onto the median plane of at least one of:

a part of a concha of the user's ear;

a complete concha of the user's ear;

a part of a cymba of the user's ear;

a complete cymba of the user's ear; and at least 30%, at least 45% or at least 60% of the complete pinna.

4. The headphone arrangement of claim 1, wherein the wall portions of the first cavity and the at least one loudspeaker form a first sound source arrangement;

the first side of the membrane of the at least one loudspeaker adjoins the at least partly enclosed volume about the ear of the user;

the wall portions of the first cavity surround the second side of the membrane of the at least one loudspeaker; and the waveguide output of the first cavity opens towards free air outside the ear cup, wall portions of the first cavity to form a rear waveguide.

5. The headphone arrangement of claim 1 further comprising a second cavity within the frame, wherein the wall portions of the first cavity, wall portions of the second cavity and the at least one loudspeaker form a first sound source arrangement;

the at least one loudspeaker is arranged within common wall portions of the first cavity and the second cavity;

the wall portions of the second cavity surround the first side of the membrane of the at least one loudspeaker;

the wall portions of the second cavity are configured to guide sound that is radiated from the first side of the membrane of the at least one loudspeaker through at least one output of the second cavity to the outside of the frame;

the wall portions of the second cavity form a second waveguide and the at least one output in the second cavity forms a waveguide output of the second waveguide; and when the ear cup is arranged to surround the ear of the user, the waveguide output of the second waveguide opens towards the at least partly enclosed volume about the ear of the user, and the waveguide output of the first waveguide opens towards free air outside the ear cup, the wall portions of the first cavity to form a rear waveguide, and the wall portions of the second cavity to form a frontal waveguide.

6. The headphone arrangement of claim 1, wherein a solid angle ($\Omega$) subtended at a geometric or acoustic center of the membrane of the at least one loudspeaker, surrounded by wall portions of at least the first waveguide by a total area within a smallest outline enclosing the waveguide output of the first waveguide is less than $\pi$ steradian or less than $\pi/2$ steradian.

7. The headphone arrangement of claim 1, wherein an air volume within at least one waveguide is less than 2 times, less than 5 times or less than 10 times a maximum volume displacement of all loudspeaker membranes that are surrounded by wall portions of the first waveguide.

8. The headphone arrangement of claim 1, wherein an area of the waveguide output of at least one waveguide is at least 30%, at least 50% or at least 70% smaller than the area of all loudspeaker membranes that are surrounded by wall portions of the waveguide.

9. The headphone arrangement of claim 1, wherein, when the ear cup is arranged to surround the ear of the user, an average distance from the waveguide output of at least one frontal waveguide to the ear canal entry of the user is at least 30%, at least 40% or at least 60% shorter than an average distance from the membrane of at least one loudspeaker, arranged within a frontal waveguide, to the ear canal entry of the user.

10. The headphone arrangement of claim 1, wherein at least one output of at least one frontal waveguide is arranged such that, when the ear cup is arranged to surround the ear of the user, an average direction of sound arrival from the at least one frontal waveguide at a concha area of the user's ear differs from an average direction from a geometric or acoustic center of the loudspeaker membrane of that at least one loudspeaker within a frontal waveguide towards a concha area of the user's ear.

11. The headphone arrangement of claim 1, further comprising at least one additional sound source arrangement within the frame, the at least one additional sound source arrangement being configured such that sound radiated by the additional sound source arrangement is directed towards a concha of the user's ear when the ear cup is arranged to surround the ear of the user.

12. The headphone arrangement of claim 1 further comprising at least one additional sound source arrangement within the frame, wherein, when the ear cup is arranged to surround the ear of the user, sound radiated by at least one sound source arrangement is directed towards a concha of the user's ear from a frontal direction in front of a frontal plane, and sound radiated by at least one sound source arrangement is directed towards the concha of the user's ear from a rear direction behind the frontal plane, wherein the frontal plane is perpendicular to a median plane and runs through both ears of the user to divide the user's head into a frontal part and a rear part.

13. The headphone arrangement of claim 1 further comprising at least two frontal waveguides arranged within the frame, wherein at least one waveguide output is configured to radiate sound towards a concha of the user's ear from a frontal direction, in front of the frontal plane, and at least one waveguide output is configured to radiate sound towards the concha of the user's ear from a rear direction, behind the frontal plane.

14. The headphone arrangement of claim 1, wherein the waveguide output of at least one frontal waveguide further comprises at least one protrusion which protrudes in a direction towards the ear of the user when the ear cup is arranged to surround the ear of the user, the at least one protrusion to reduce a volume into which sound from the waveguide output expands until the sound reaches the ear canal entry of the user.

15. The headphone arrangement of claim 1 further comprising at least two waveguides arranged within the frame, wherein the waveguide outputs of the two waveguides are arranged adjacent to each other to form an essentially continuous combined waveguide output along parts of the frame.

16. The headphone arrangement of claim 15, wherein at least one continuous combined waveguide output is arranged on parts of the frame such that the at least one continuous combined waveguide output runs approximately parallel to at least a part of a lateral contour of a perimeter of a user's pinna, when the ear cup is arranged to surround the ear of the user.

17. The headphone arrangement of claim 1 further comprising a removable cover that is configured to be attached to the frame to laterally cover the ear at least partly, when the ear cup is arranged to surround the ear of the user.

18. The headphone arrangement of claim 17, wherein the arrangement is configured to detect at least one of:

whether a removable cover is attached to the frame; and which of at least two different types of the removable cover is attached to the frame.

19. The headphone arrangement of claim 1, wherein the ear cup further comprises a cover that is attached to the frame and laterally covers the ear at least partly when the ear cup is arranged to surround the ear of the user to form a partly open or completely closed ear cup.

20. The headphone arrangement of claim 1, further comprising a cushion which is arranged between the frame and the user's head when the ear cup is arranged to surround the ear of the user, the cushion being configured to attenuate low frequency sound that propagates between the frame and the head of the user, the cushion comprising at least one of:

a closed cell foam;

the closed cell foam and an open cell foam;

the open cell foam which is at least partly covered by a material with low air permeability;

the open cell foam which is at least partly bonded to a material with low air permeability;

a soft material with a volume weight of more than 50 kg/m3; and a gel comprising a fluid.

21. The headphone arrangement of claim 1 further comprising a cushion which is arranged between the frame and the user's head when the ear cup is arranged to surround the ear of the user, wherein the cushion is configured to reduce acoustic reflections directed towards the ear of the user, and wherein the cushion comprises at least one of:

a sound absorbing material;

the sound absorbing material which is at least partly covered by a material with high air permeability;

an open cell foam which is at least partly covered by a material with high air permeability;

a sound absorbing fabric; and sound absorbing fibers.

22. The headphone arrangement of claim 1, wherein an approximated sound pressure loss IL, caused by at least one waveguide output with a cross section area smaller than a membrane area of the at least one loudspeaker within the first waveguide, is less than 0.5 dB or less than 0.75 dB, wherein the sound pressure loss IL is approximated as $IL=0.01*(Vd/Aw)^2+0.001*(Vd/Aw)$, wherein Vd is a maximum volume displacement of the membrane of the at least one loudspeaker, and Aw is a cross section area of the waveguide output.

23. A headphone arrangement comprising:

an ear cup configured to be arranged to at least partly surround an ear of a user, to define an at least partly enclosed volume about the ear of the user, wherein the ear cup comprises an at least partly hollow frame configured to at least partly enframe the at least partly enclosed volume about the ear of the user when the ear cup is arranged to surround the ear of the user; and at least one loudspeaker comprising a membrane with a first side and a second side, the at least one loudspeaker is arranged within wall portions of the first cavity, wherein wall portions of the first cavity form a first waveguide configured to guide sound radiated from the first side or from the second side of the loudspeaker membrane through a waveguide output of the first waveguide, the waveguide output of the first waveguide comprises one or more openings in the first cavity, and either sound radiated from the first side of the loudspeaker membrane, or sound radiated from the second side of the loudspeaker membrane is directed towards the at least partly enclosed volume about the ear of the user, and a second cavity within the frame, wherein the wall portions of the first cavity, wall portions of the second cavity and the at least one loudspeaker form a first sound source arrangement;

the at least one loudspeaker is arranged within common wall portions of the first cavity and the second cavity;

the wall portions of the second cavity surround the first side of the membrane of the at least one loudspeaker;

the wall portions of the second cavity are configured to guide sound that is radiated from the first side of the membrane of the at least one loudspeaker through at least one output of the second cavity to the outside of the frame;

the wall portions of the second cavity form a second waveguide and the at least one output in the second cavity forms a waveguide output of the second waveguide; and when the ear cup is arranged to surround the ear of the user, the waveguide output of the second waveguide opens towards the at least partly enclosed volume about the ear of the user, and the waveguide output of the first waveguide opens towards free air outside the ear cup, the wall portions of the first cavity to form a rear waveguide, and the wall portions of the second cavity to form a frontal waveguide.

24. A headphone arrangement comprising:

an ear cup configured to be arranged to at least partly surround an ear of a user to define an at least partly enclosed volume about the ear of the user, wherein the ear cup comprises an at least partly hollow frame configured to at least partly enframe the at least partly enclosed volume about the ear of the user when the ear cup is arranged to surround the ear of the user, the frame to at least partly enframing at least a part of the ear of the user as viewed from a lateral direction when the ear cup is arranged to at least partly surround the ear of the user, and wherein the frame comprises a first cavity, the first cavity being formed by wall portions of the frame;

at least one loudspeaker comprising a membrane with a first side and a second side, the at least one loudspeaker is arranged within wall portions of the first cavity, wherein wall portions of the first cavity form a first waveguide configured to guide sound radiated from the first side or from the second side of the loudspeaker membrane through a waveguide output of the first waveguide, the waveguide output of the first waveguide comprises one or more openings in the first cavity, and either sound radiated from the first side of the loudspeaker membrane, or sound radiated from the second side of the loudspeaker membrane is directed towards the at least partly enclosed volume about the ear of the user; and a removable cover that is configured to be attached to the frame to laterally cover the ear at least partly, when the ear cup is arranged to surround the ear of the user, wherein the arrangement is configured to detect at least one of:

whether a removable cover is attached to the frame; and which of at least two different types of the removable cover is attached to the frame.

* * * * *